United States Patent [19]

Kuwabara et al.

[11] Patent Number: 4,999,276

[45] Date of Patent: Mar. 12, 1991

[54] SILVER HALIDE PHOTOGRAPHIC MATERIALS

[75] Inventors: Ken-ichi Kuwabara; Kunio Ishigaki; Takayuki Inayama, all of Kanagawa, Japan

[73] Assignee: Fuji Photo Film Co. Ltd., Tokyo, Japan

[21] Appl. No.: 372,750

[22] Filed: Jun. 28, 1989

[30] Foreign Application Priority Data

Jun. 29, 1988 [JP] Japan ..... 63-162146
Jul. 7, 1988 [JP] Japan ..... 63-169316

[51] Int. Cl.[5] ..... G03C 1/06

[52] U.S. Cl. ..... 430/264; 430/527; 430/529; 430/530

[58] Field of Search ..... 430/264, 527, 530, 529

[56] References Cited

U.S. PATENT DOCUMENTS

| | | | |
|---|---|---|---|
| 4,495,276 | 1/1985 | Takimoto et al. | 430/527 |
| 4,797,353 | 1/1989 | Yamada et al. | 430/434 |
| 4,803,149 | 2/1989 | Takahashi et al. | 430/264 |
| 4,818,659 | 4/1989 | Takahashi et al. | 430/264 |

*Primary Examiner*—Paul R. Michl
*Assistant Examiner*—Janis L. Dote
*Attorney, Agent, or Firm*—Sughrue, Mion, Zinn, Macpeak & Seas

[57] ABSTRACT

A silver halide photographic material which comprises a support having thereon at least one of silver halide emulsion layer and other hydrophilic colloid layer where at least one of said silver halide emulsion layer and other hydrophilic colloid layer contains a hydrazine derivative represented by formula (I), and also having thereon, as a constitutional layer, at least one electroconductive layer having a surface resistivity of $1\times10^{12}\ \Omega$ or less in an atmosphere of 25° C. and 25% RH;

$$R_1-\underset{\underset{A_1}{|}}{N}-\underset{\underset{A_2}{|}}{N}-G_1-R_2 \qquad (I)$$

wherein $R_1$ represents an aliphatic group or an aromatic group; $R_2$ represents a hydrogen atom, an alkyl group, an aryl group, an alkoxy group, an aryloxy group, an amino group, a carbamoyl group or an oxycarbonyl group; $G_1$ represents a carbonyl group, a sulfonyl group, a sulfoxy group, $$-\overset{\overset{O}{\|}}{\underset{\underset{R_2}{|}}{P}}-$$

or an iminomethylene group; $A_1$ and $A_2$ are both hydrogen atoms, or one of them represents a hydrogen atom and the other represents a substituted or unsubstituted alkylsulfonyl group, a substituted or unsubstituted arylsulfonyl group, or a substituted or unsubstituted acyl group. The material can be processed with a stable developer under a bright room condition to give a high contrast image. The material processed has negligible pinholes.

6 Claims, 1 Drawing Sheet

FIGURE
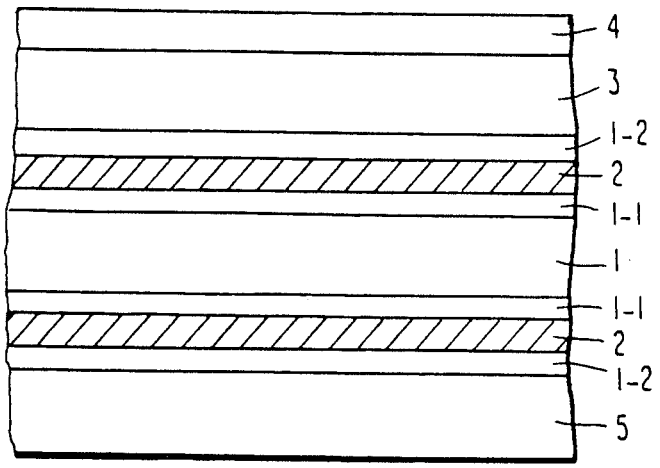

SILVER HALIDE PHOTOGRAPHIC MATERIALS

FIELD OF THE INVENTION

The present invention relates to a silver halide photographic material and to a method for forming a high contrast negative image by using the same. In particular, it relates to a silver halide photographic material which can be processed in the ambience of a so-called bright room in the field of printing or photomechanical processing.

BACKGROUND OF THE INVENTION

In the field of printing and photomechanical processing, improvement of operation efficiency in the photomechanical processing step is desired in order to satisfactorily handle the diversity and complexity of prints.

In particular, the plate making step as well as the contact work step is required to be operated in a brighter room for the purpose of rationalization of the operation, economization of energy and improvement of the environment. Under such situation, the development of photographic materials and of exposing printers is advancing.

Photographic materials which can be processed in a bright room are specifically those which can be processed in a room having a lightness of from 100 to 300 luxes from the use of a fluorescent lamp with a reduced ultraviolet ray emission, or a light not having the wavelength of 400 nm or less as a safelight source.

As the light source for such bright room type silver halide photographic materials, there are mentioned, for example, a high pressure mercury lamp, a metal halide, a microwave discharge type mercury nonelectrode light source, a xenon lamp and a halogen lamp.

In order to obtain good character images, line images or dot images by contact exposure of such bright room type silver halide photographic material with a printer using the above-mentioned light which is rich in the wavelength component of from visible to ultraviolet ranges, the photographic material is required to have a high contrast photographic characteristic (especially having a gamma value of 10 or more), and various image-forming systems for such material have heretofore been provided.

As one method for obtaining such high contrast photographic characteristic by the use of a stable developer, it is known to use hydrazine derivatives, for example, as described in U.S. Pat. Nos. 4,224,401, 4,168,977, 4,166,742, 4,311,781, 4,272,606, 4,221,857 and 4,269,929. In accordance with such a method, a photographic characteristic of high contrast and high sensitivity can be obtained. In addition, since a sulfite of a high concentration is allowed to be added to the developer, the stability of the developer against aerial oxidation is noticeably improved as compared with a lith developer.

Hydrazine derivative-containing low sensitive bright room type photographic materials are described in, for example, JP-A-60-14038, JP-A-60-162246, JP-A-61-238049 and JP-A-63-208846 (the term "JP-A" as used herein refers to a "published unexamined Japanese patent application"), British Patent 2,202,341A, and Japanese Patent Application No. 62-218648.

However, when such high contrast photographic materials are subjected to contact work exposure with an exposure printer, the photographic material would be contacted with another or with some other substance of a different kind, or would be peeled off from another photographic material contacted or some other substance of a different kind, to cause surface friction therebetween, whereby an electrostatic charge would be accumulated on the surface of the materials. Because of the thus-charged electricity, dust would inevitably adhere to the surface of the photographic material being processed or the original film to cause pinholes in the material developed. Accordingly, extreme effort is needed for correcting the pinhole problem or in re-exposing the material. Such is a serious problem. In order to overcome such a problem, a technique of using a surfactant for improving the electrified characteristic of photographic materials has been proposed as described in U.S. Pat. Nos. 2,982,652, 3,428,456, 3,457,076, 3,454,625, 3,552,972, 3,655,387, 2,992,108 and 3,206,312, JP-A-49-85826, JP-A-49-33630, JP-A-48-87826, JP-A-61-41143, JP-B-49-11567 and JP-B-49-11568 (the term "JP-B" as used herein refers to an "examined Japanese patent publication"), which, however, is still insufficient. Under the circumstances, therefore, development of photographic materials which hardly give pinholes is strongly desired in this technical field.

SUMMARY OF THE INVENTION

The object of the present invention is to provide a silver halide photographic material which has extremely high contrast and has a gamma value of more than 10 and which has hardly any pinholes after being processed.

In accordance with the present invention to attain the said object, there is provided a silver halide photographic material which comprises a support having thereon at least one silver halide emulsion layer and another hydrophilic colloid layer where at least one of the silver halide emulsion layers and the hydrophilic colloid layers contains a hydrazine derivative represented by formula (I), and also having thereon, as a constitutional layer, at least one electroconductive layer having a surface resistivity of $1\times10^{12}\Omega$ or less in an atmosphere of 25° C. and 25% RH;

$$R_1-\underset{\underset{A_1}{|}}{N}-\underset{\underset{A_2}{|}}{N}-G_1-R_2 \qquad (I)$$

wherein $R_1$ represents an aliphatic group or an aromatic group; $R_2$ represents a hydrogen atom, an alkyl group, an aryl group, an alkoxy group, an aryloxy group, an amino group, a carbamoyl group or an oxycarbonyl group; $G_1$ represents a carbonyl group, a sulfonyl group, a sulfoxy group, $$-\overset{\overset{O}{\|}}{\underset{\underset{R_2}{|}}{P}}-$$

or an iminomethylene group; both $A_1$ and $A_2$ represent hydrogen atoms, or one of them is a hydrogen atom and the other is a substituted or unsubstituted alkylsulfonyl group, a substituted or unsubstituted arylsulfonyl group or a substituted or unsubstituted acyl group.

BRIEF DESCRIPTION OF THE DRAWING

The FIGURE is a sectional view to show the layer constitution of one embodiment of the photographic material of the present invention.

DETAILED DESCRIPTION OF THE INVENTION

As the electroconductive substance to be used in the electroconductive layer of the present invention, there are mentioned electroconductive metal oxides and electroconductive high polymer compounds.

Preferred electroconductive metal oxides for use in the present invention are crystalline metal oxide grains. In particular, those having oxygen defect as well as those containing a small amount of diverse atoms forming a donor to the metal oxide to be used are especially preferred, as they generally have a high electroconductivity. Above all, the latter are specifically preferred as they do not cause fogging in silver halide emulsions. As examples of metal oxides, there are preferably mentioned ZnO, $TiO_2$, $SnO_2$, $Al_2O_3$, $In_2O_3$, $SiO_2$, MgO, BaO, $MoO_3$, $V_2O_5$ and composite oxides thereof, and in particular, ZnO, $TiO_2$ and $SiO_2$ are especially preferred. As examples of containing diverse atoms, for example, Al or In may effectively be added to ZnO; Sb, Nb or halogen atoms may be added to $SnO_2$; and Nb or Ta may be added to $TiO_2$. The amount of the diverse atom to be added is preferably within the range of from 0.01 mol % to 30 mol %, and especially preferably from 0.1 mol % to 10 mol %.

The fine metal oxide grains for use in the present invention are electroconductive and have a volume resistivity of preferably $1\times10^7$ Ω·cm or less, and especially preferably $1\times10^5$ Ω·cm or less.

The metal oxides are described in, for example, JP-A-56-143431, JP-A-56-120519 and JP-A-58-62647.

Electroconductive materials formed by applying the above-mentioned metal oxides to other crystalline metal oxide grains or fibrous substances (for example, titanium oxide), which are described in JP-B-59-6235, may also be used.

The grain size of the fine electroconductive metal oxide grains for use in the present invention is preferably 10 μm or less, and more preferably 2 μm or less for easy use, as such fine grains are satisfactorily stable when dispersed and therefore can be easily handled. In order to minimize the light-scattering property of the material, use of fine electroconductive grains having a grain size of 0.5 μm or less is particularly desirable when transparent photographic materials are to be made.

When the electroconductive material for use in the present invention is needle-like or fibrous, the length is preferably 30 μm or less, more preferably 25 μm or less, and the diameter is preferably 2 μm or less, more preferably 0.5 μm or less, and the ratio of length/diameter is preferably 3 or more and more preferably from 5 to 300.

As the electroconductive high polymer compound for use in the present invention, there are preferably mentioned, for example, polyvinyl benzenesulfonic acid salts, polyvinyl benzyltrimethylammonium chlorides, as well as quaternary salt polymers described in U.S. Pat. Nos. 4,108,802, 4,118,231, 4,126,467 and 4,137,217 and polymer latexes described in U.S. Pat. No. 4,070,189, West German Patent (OLS) 2,830,767 and JP-A-61-296352 and JP-A-61-62033.

Specific examples of electroconductive high polymer compounds for use in the present invention are mentioned below, which, however, are not whatsoever limitative.

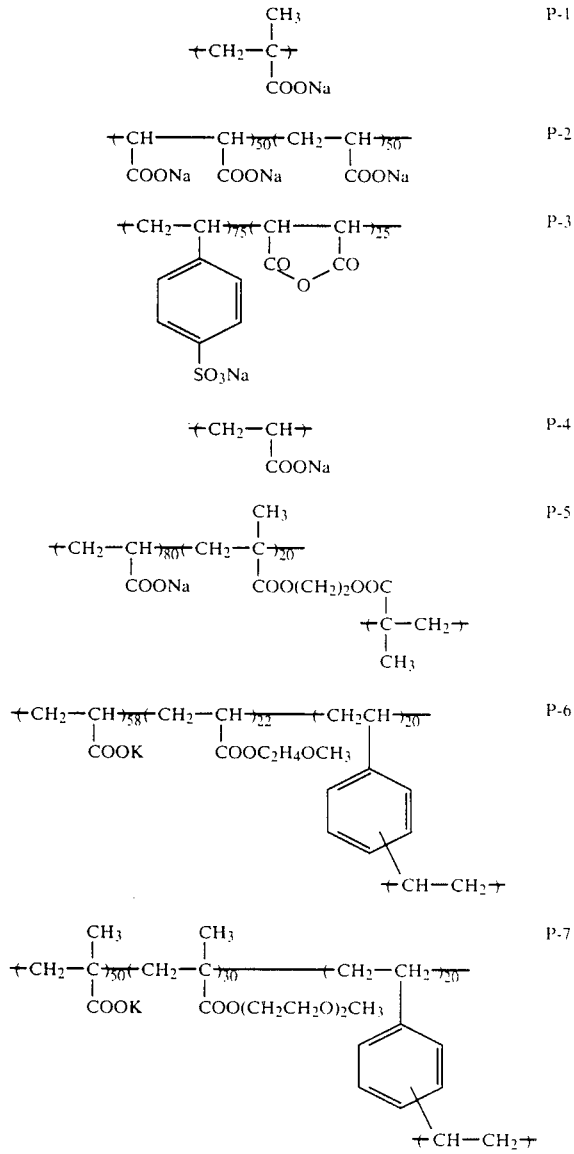

In accordance with the present invention, the electroconductive metal oxide or electroconductive high polymer compound is dispersed or dissolved in a binder.

The binder to be used for the above purpose is not specifically limited, but may be any one having a film-forming ability. For example, there are mentioned proteins such as gelatin or casein; cellulose compounds such as carboxymethyl cellulose, hydroxyethyl cellulose, acetyl cellulose, diacetyl cellulose or triacetyl cellulose; saccharides such as dextran, agar, sodium alginate or starch derivatives; and synthetic polymers such as polyvinyl alcohol, polyvinyl acetate, polyacrylate, polymethacrylate, polystyrene, polyacrylamide, poly-N-vinylpyrrolidone, polyester, polyvinyl chloride or polyacrylic acid.

In particular, gelatin (lime-processed gelatin, acid-processed gelatin, enzyme-decomposed gelatin, phthalated gelatin, acylated gelatin), and acetyl cellulose, diacetyl cellulose, triacetyl cellulose, polyvinyl acetate, polyvinyl alcohol, polybutyl acrylate, polyacrylamide and dextran are especially preferred for use in the present invention.

In order to lower the resistance of the electroconductive layer for effective use of the electroconductive metal oxide or electroconductive high polymer in the present invention, it is desired that the volume resistivity of the electroconductive substance be high. However, since the layer is required to have a binder in an amount of at least 5% or so in order to have a sufficient strength for itself, the content by volume of the electroconductive metal oxide or electroconductive high polymer compound in the layer is preferably within the range of from 5 to 95% and more preferably from 20 to 80%.

In accordance with the present invention, the amount of the electroconductive metal oxide or electroconductive high polymer compound to be used is preferably from 0.05 to 20 g, more preferably from 0.1 to 10 g, per $m^2$ of the photographic material. The electroconductive layer of the material of the present invention has a surface resistivity of $1\times10^{12}\Omega$ or less, preferably $1\times10^{11}\Omega$ or less, in an atmosphere of 25° C. and 25% RH, and it is desired that the layer retains a surface resistivity of $1\times10^{12}\Omega$ or less even after development, whereby the material of the present invention possesses a good antistatic property.

The photographic material of the present invention has at least one electroconductive layer containing the said electroconductive metal oxide or electroconductive high polymer compound as a constitutional layer of the material. For instance, the electroconductive layer may be any one of a surface protective layer, backing layer, interlayer and subbing layer of the constitutional layers of the material, and if desired, the material may have two or more electroconductive layers.

In accordance with the present invention, it is further preferred to use a fluorine-containing surfactant in the material in addition to the said electroconductive substance so as to obtain a better antistatic property.

As preferred fluorine-containing surfactants to be used for the above purpose, there are mentioned, for example, surfactants having a fluoroalkyl, fluoroalkenyl or fluoroaryl group having 4 or more carbon atoms. Those having, as an ionic group, an anionic group (e.g., sulfonic acid or salt, sulfuric acid or salt, carboxylic acid or salt, phosphoric acid or salt), a cationic group (e.g., amine salt, ammonium salt, aromatic amine salt, sulfonium salt, phosphonium salt), a betaine group (e.g., carboxyamine salt, carboxyammonium salt, sulfoamine salt, sulfoammonium salt, phosphoammonium salt) or a nonionic group (e.g., substituted or unsubstituted polyoxyalkylene group, polyglyceryl group, sorbitan residue group) are especially preferred.

Such fluorine-containing surfactants are described in JP-A-49-10722, JP-A-55-149938, JP-A-58-196544 and JP-A-60-80849, British Patent 1,330,356, U.S. Pat. Nos. 4,335,201, 4,347,308 and 4,201,586, British Patent 1,417,915, JP-A-55-149938 and JP-A-58-196544 and British Patent 1,439,402.

Preferred examples of the surfactants are mentioned below.

$C_8F_{17}SO_3K$ F-1

$C_8F_{17}SO_3N(C_2H_5)_4$ F-2

$C_7F_{15}COONa$ F-3

$C_8F_{17}CH_2CH_2OSO_3Na$ F-4

$C_8F_{17}SO_2N(C_3H_7)-CH_2COOK$ F-5

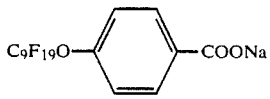

F-6

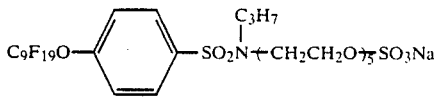

F-7

$C_8F_{17}SO_2N(C_3H_7)(CH_2CH_2O)_4(CH_2)_4SO_3Na$ F-8

$C_8F_{17}SO_2N(C_3H_7)(CH_2CH(OH)CH_2O)_3SO_3K$ F-9

$C_9F_{19}COOCH_2CH(OH)CH_2SO_3Na$ F-10

$C_8F_{17}SO_2N(C_{12}H_{25})(CH_2CH(OH)CH_2O)_2(CH_2CH_2O)SO_3K$ F-11

$C_8F_{17}CH_2CH_2OOC-CH_2$
$C_4H_9OOC-CH-SO_3Na$ F-12

-continued

F-13

$$C_8F_{17}SO_2\overset{H}{N}CH_2CH_2CH_2OCH_2CH_2\overset{\oplus}{N}(CH_3)_2-CH_2CH_2COO^{\ominus}$$

F-14

$$C_8F_{17}SO_2\overset{H}{N}CH_2CH_2CH_2-\overset{\oplus}{N}(CH_3)(CH_2)_4SO_3^{\ominus}$$

F-15

$$C_8F_{17}SO_2\overset{H}{N}CH_2CH_2\overset{\oplus}{N}(CH_2CH_2OH)_2-CH_2COO^{\ominus}$$

F-16

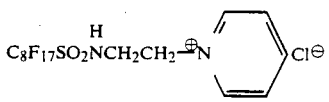

F-17

$$C_8F_{17}SO_2\overset{H}{N}CH_2CH_2\overset{\oplus}{N}(CH_3)_2-CH_3\ I^{\ominus}$$

F-18

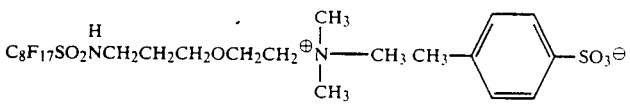

F-19

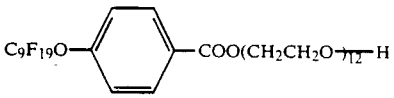

F-20

$$C_8F_{17}SO_2\overset{C_{10}H_{21}}{N}(CH_2CH_2O)_{12.5}H$$

F-21

$$C_6F_{13}SO_2N\begin{cases}(CH_2CH_2O)_nH\\(CH_2CH_2O)_mH\end{cases}$$

$n + m = 11.5$

F-22

$$C_8F_{17}SO_2\overset{C_3H_7}{N}(CH_2CH_2O)_{15}H$$

F-23

$$C_8H_{17}SO_2\overset{C_2H_5}{N}(CH(CH_3)-CH_2-O)_5(CH_2CH_2O)_{13.5}H$$

F-24

$$C_8F_{17}CH_2CH_2O(CH_2CH_2O)_{12.5}H$$

F-25

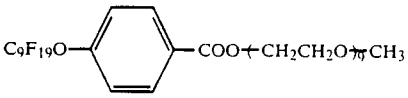

F-26

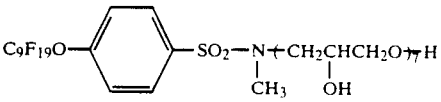

F-27

$$C_8F_{17}SO_2\overset{C_3H_7}{N}(CH_2CH(OH)-CH_2-O)_2(CH_2CH_2O)_{10}H$$

The fluorine-containing surfactant may be added to at least one layer of the photographic material of the present invention, without being specifically limited, and, for example, it may be added to any one of a surface protective layer, emulsion layer, interlayer, subbing layer and backing layer.

When the surface protective layer is composed of two or more layers, the surfactant may be added to any one of them, or alternatively, it may be overcoated on the surface protective layer.

The amount of the fluorine-containing surfactant to be used in the present invention may be generally from 0.0001 to 1 g, preferably from 0.0002 to 0.25 g, and especially preferably from 0.0003 to 0.1 g, per $m^2$ of the photographic material.

Two or more of the fluorine-containing surfactants can be used in mixture.

In accordance with the present invention, any other antistatic agent can be incorporated into the layer containing the fluorine-containing surfactant or into any other, whereby the photographic material may have a better antistatic capacity.

Next, the hydrazine derivatives of formula the (I) for use in the present invention will be explained in detail.

The hydrazine derivatives are of the formula:

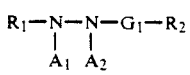

(I)

wherein $R_1$ represents an aliphatic group or an aromatic group; $R_2$ represents a hydrogen atom, an alkyl group, an aryl group, an alkoxy group, an aryloxy group, an amino group, a carbamoyl group or an oxycarbonyl group; $G_1$ represents a carbonyl group, a sulfonyl group, a sulfoxy group,

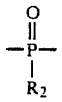

or an iminomethylene group; $A_1$ and $A_2$ both represent hydrogen atoms, or one of them is a hydrogen atom and the other is a substituted or unsubstituted alkylsulfonyl group, a substituted or unsubstituted arylsulfonyl group or a substituted or unsubstituted acyl group.

In the formula (I), the aliphatic group for $R_1$ preferably has from 1 to 30 carbon atoms, and it is especially a straight chain, branched or cyclic alkyl group having from 1 to 20 carbon atoms. The branched alkyl group may be cyclized to form a saturated hetero ring containing one or more (preferably from 1 to 3) hetero atoms therein. The alkyl group may optionally have substituent(s) selected from an aryl group, an alkoxy group, a sulfoxy group, a sulfonamido group and a carbonamido group.

In the formula (I), the aromatic group for $R_1$ is a monocyclic or bicyclic aryl group containing from 6 to 12 carbon atoms or an unsaturated heterocyclic group containing from 3 to 8 members including hetero atoms selected from N, O, S or Se. The unsaturated heterocyclic group may be bonded to a monocyclic or bicyclic aryl group to form a hetero aryl group.

For instance, there are mentioned a benzene ring, a naphthalene ring, a pyridine ring, a pyrimidine ring, an imidazole ring, a pyrazole ring, a quinoline ring, an isoquinoline ring, a benzimidazole ring, a thiazole ring and a benzothiazole ring. Above all, benzene ring-containing groups are especially preferred.

$R_1$ is especially preferably an aryl group having preferably from 6 to 12 carbon atoms.

The aryl group and unsaturated heterocyclic group for $R_1$ may optionally be substituted. As specific examples of the substituents for these groups, there are mentioned a straight chain, branched or cyclic alkyl group (preferably having from 1 to 20 carbon atoms), an aralkyl group (preferably mono- or bicyclic group having from 1 to 3 carbon atoms in the alkyl moiety), an alkoxy group (preferably having from 1 to 20 carbon atoms), a substituted amino group (preferably an amino group substituted by an alkyl group having from 1 to 20 carbon atoms), an acylamino group (preferably having from 2 to 30 carbon atoms), a sulfonamido group (preferably having from 1 to 30 carbon atoms) and a ureido group (preferably having from 1 to 30 carbon atoms).

In the formula (I), the alkyl group for $R_2$ is preferably an alkyl group having from 1 to 4 carbon atoms, which may optionally have substituent(s) selected from a halogen atom, a cyano group, a carboxyl group, a sulfo group, an alkoxy group and an aryl group such as a phenyl group.

The aryl group for $R_2$ is preferably a mono- or bicyclic aryl group having from 6 to 12 carbon atoms and, for example, it is a benzene ring-containing group. The aryl group may optionally be substituted by substituent(s) selected from a halogen atom, an alkyl group, a cyano group, a carboxyl group and a sulfo group.

As the alkoxy group, one having from 1 to 8 carbon atoms is preferred, which may optionally be substituted by a halogen atom, an aryl group or the like.

As the aryloxy group, a monocyclic group having from 6 to 12 carbon atoms is preferred, which may optionally be substituted by a halogen atom.

As the amino group, an unsubstituted amino group as well as an alkylamino or arylamino group, having from 1 to 10 carbon atoms is preferred, which may optionally be substituted by an alkyl group, a halogen atom, a cyano group, a nitro group, a carboxyl group or the like.

As the carbamoyl group, an unsubstituted carbamoyl group as well as an alkylcarbamoyl or arylcarbamoyl group, having from 1 to 10 carbon atoms is preferred, which may optionally be substituted by an alkyl group, a halogen atom, a cyano group, a carboxyl group or the like.

As the oxycarbonyl group, an alkoxycarbonyl or aryloxycarbonyl group, having from 1 to 10 carbon atoms is preferred, which may optionally be substituted by an alkyl group, a halogen atom, a cyano group, a nitro group or the like.

When $G_1$ is a carbonyl group, $R_2$ is preferably a hydrogen atom, an alkyl group (e.g., methyl, trifluoromethyl, 3-hydroxypropyl, 3-methanesulfonamidopropyl), an aralkyl group (e.g., o-hydroxybenzyl) or an aryl group (e.g., phenyl, 3,5-dichlorophenyl, o-methanesulfonamidophenyl, 4-methanesulfonylphenyl), and it is most preferably a hydrogen atom.

When $G_1$ is sulfonyl group, $R_2$ is preferably an alkyl group (e.g., methyl), an aralkyl group (e.g., o-hydroxyphenylmethyl), an aryl group (e.g., phenyl) or a substituted amino group (e.g., dimethylamino).

When $G_1$ is a sulfoxy group, $R_2$ is preferably a cyanobenzyl group or a methylthiobenzyl group.

When $G_1$ is

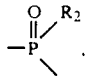

$R_2$ is preferably methoxy, ethoxy, butoxy, phenoxy or phenyl group, and it is most preferably phenoxy group.

When $G_1$ is an N-substituted or unsubstituted iminomethylene group, $R_2$ is preferably methyl or ethyl group, or a substituted or unsubstituted phenyl group.

As the substituents for $R_2$, the substituents mentioned for $R_1$ in the above may also apply to $R_2$.

$G_1$ in the formula (I) is most preferably a carbonyl group.

$R_2$ may include a group having a function of cleaving the $G_1$—$R_2$ moiety from the residual molecule to cause a cyclizing reaction forming a circular structure containing the atoms of the —$G_1$—$R_2$ moiety. For instance, the group can be represented by the formula (a):

$$-R_3-Z_1 \qquad (a)$$

wherein $Z_1$ is a group having a function of nucleophilically attacking $G_1$ thereby to cleave $G_1$—$R_3$—$Z_1$ moiety from the residual molecular part; $R_3$ represents a group derived from $R_2$ by removing one hydrogen atom therefrom; and $Z_1$ nucleophilically attacks $G_1$ to be able to form a cyclic structure composed of $G_1$, $R_2$ and $Z_1$.

More preferably, $Z_1$ is a group which may easily react with $G_1$ when the hydrozine compound of formula (I) has been oxidized to form the following reaction intermediate: $R_1$—N=N—$G_1$—$R_3$—$Z_1$, thereby to cleave $R_1$—N=N— from $G_1$. For instance, the group includes a functional group capable of directly reacting with $G_1$, such as OH, SH, $NHR_4$ and COOH where $R_4$ is a hydrogen atom, an alkyl group, an aryl group, —$COR_5$ or —$SO_2R_5$, and $R_5$ is a hydrogen atom, an alkyl group, an aryl group or a heterocyclic group, in which OH, SH, $NHR_4$ and COOH may temporarily be protected to form a protected group capable of yielding such group by hydrolysis with an alkali, and a functional group capable of reacting with $G_1$ in the presence of a nucleophilic agent (e.g., hydroxyl ion, sulfite ion), such as

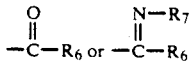

where $R_6$ and $R_7$ each is a hydrogen atom, an alkyl group, an alkenyl group, an aryl group or a heterocyclic group.

The ring composed of $G_1$, $R_3$ and $Z_1$ is preferably a 5-membered or 6-membered one.

Of the groups of the formula (a), those represented by the formula (b) or (c) are preferred.

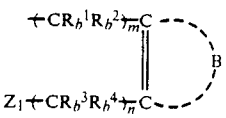

(b)

wherein $R_b^1$ to $R_b^4$ may be the same or different and each represents a hydrogen atom, an alkyl group (preferably having from 1 to 12 carbon atoms), an alkenyl group (preferably having from 2 to 12 carbon atoms) or an aryl group (preferably having from 6 to 12 carbon atoms); B represents an atomic group necessary for completing an optionally substituted 5-membered or 6-membered ring; and m and n each represents 0 or 1, and (n+m) is 1 or 2.

The 5- or 6-membered ring formed by B includes, for example, a cyclohexene ring, a cycloheptene ring, a benzene ring, a naphthalene ring, a pyridine ring and a quinoline ring.

$Z_1$ has the same meaning as that in formula (a).

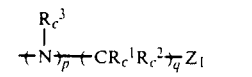

(c)

wherein $R_c^1$ and $R_c^2$ may be the same or different and each represents a hydrogen atom, an alkyl group, an alkenyl group, an aryl group or a halogen atom; $R_c^3$ represents a hydrogen atom, an alkyl group, an alkenyl group or an aryl group; p represents 0 or 1; and q represents from 1 to 4; $R_c^1$, $R_c^2$ and $R_c^3$ may be bonded to each other to form a ring, provided that $Z_1$ has a structure of attacking $G_1$ by intramolecular nucleophilic reaction.

Precisely, $R_c^1$ and $R_c^2$ each is preferably a hydrogen atom, a halogen atom or an alkyl group. $R_c^3$ is preferably an alkyl group or an aryl group.

q is preferably from 1 to 3. When q is 1, p is preferably 1 or 2; when q is 2, p is preferably 0 or 1; and when q is 3, p is preferably 0 or 1. When q is 2 or 3, $R_c^1$ and $R_c^2$ may be the same or different.

$Z_1$ has the same meaning as that in the formula (a).

In the formula (I), $A_1$ and $A_2$ each is preferably a hydrogen atom, or one of them is an alkylsulfonyl or an arylsulfonyl group, having 20 or less carbon atoms, (more preferably an unsubstituted phenylsulfonyl group or a phenylsulfonyl group substituted by a substituent(s) to satisfy the condition of having the sum of the Hammett's substituent constant of being −0.5 or more) or an acyl group having 20 or less carbon atoms (more preferably an unsubstituted benzoyl group, a benzoyl group substituted by a substituent(s) to satisfy the condition of having the sum of the Hammett's substituent constant of being −0.5 or more, or a straight chain, branched or cyclic unsubstituted or substituted aliphatic acyl group, the substituent for the group being selected, for example, from a halogen atom, an ether group, a sulfonamido group, a carbonamido group, a hydroxyl group, a carboxyl group and a sulfonic acid group).

Most preferably, $A_1$ and $A_2$ are hydrogen atoms.

In the formula (I), $R_1$ or $R_2$ may have a ballast group which is generally used in passive (immobile) photographic additives, such as a coupler, therein. The ballast group to be used for the purpose is a group which is relatively inactive to photographic characteristics and which has 8 or more carbon atoms. For instance, it may be selected from an alkyl group, an alkoxy group, a phenyl group, an alkylphenyl group, a phenoxy group and an alkylphenoxy group.

In the formula (I), $R_1$ or $R_2$ may have a group which has a function of enhancing the adsorbability of the compound to the surface of silver halide grains therein. As examples of such adsorbable groups, there are mentioned the groups described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234246 and JP-A-63-234246, such as a thiourea group, a heterocyclic thioamide group, a mercapto heterocyclic group or a triazole group.
Specific examples of the compounds of the formula (I) are mentioned below, which, however, are not intended to restrict the scope of the present invention.
(I-1)
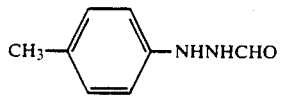
(I-2)
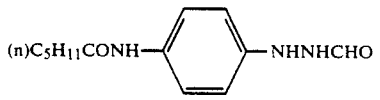
(I-3)
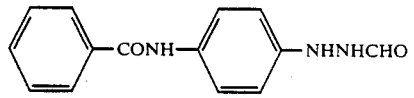
(I-4)
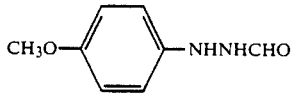
(I-5)
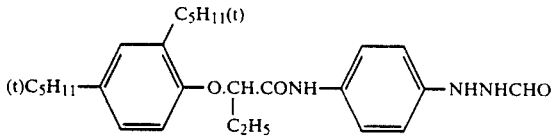
(I-6)
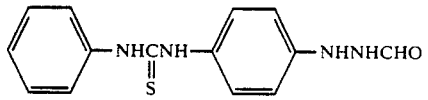
(I-7)
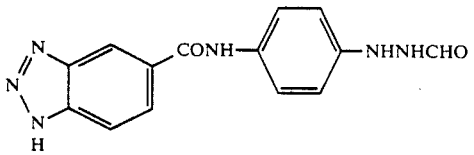
(I-8)
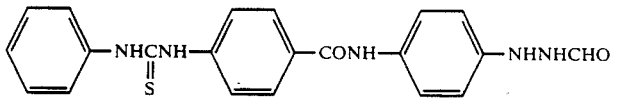
(I-9)
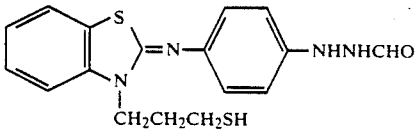
(I-10)
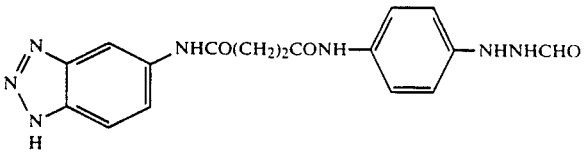
(I-11)
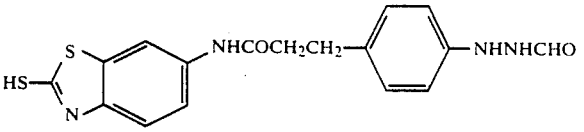

-continued
(I-12)
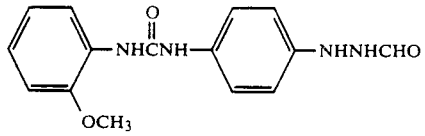
(I-13)
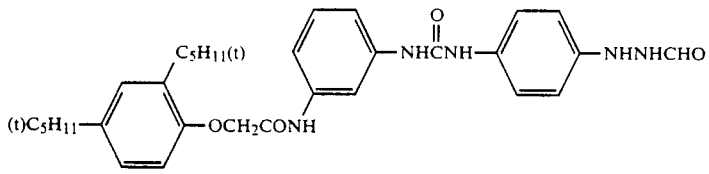
(I-14)
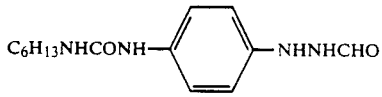
(I-15)
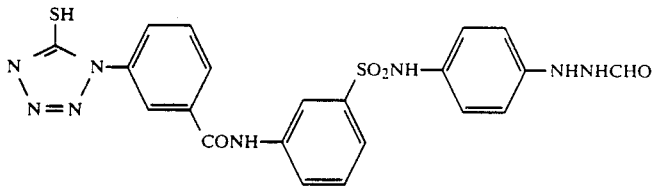
(I-16)
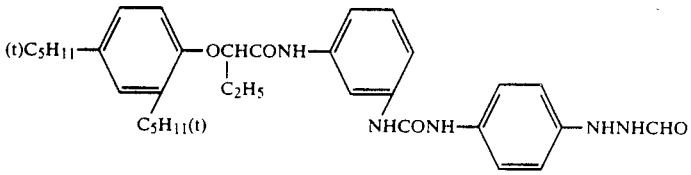
(I-17)
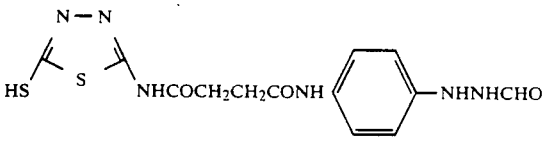
(I-18)
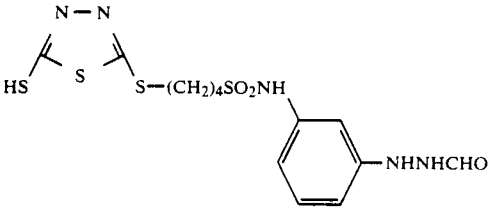
(I-19)
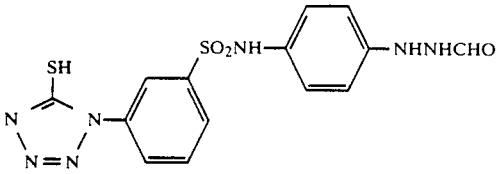
(I-20)
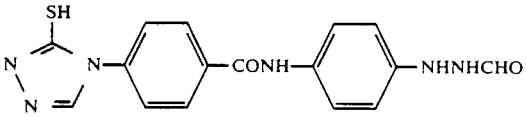

-continued
(I-21)
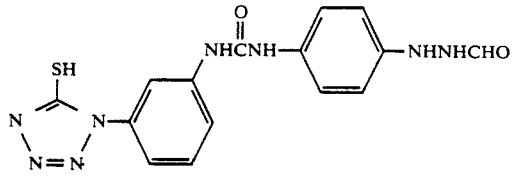
(I-22)
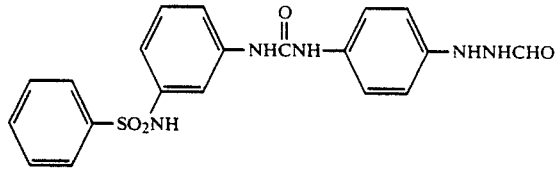
(I-23)
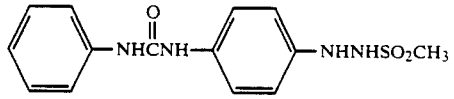
(I-24)
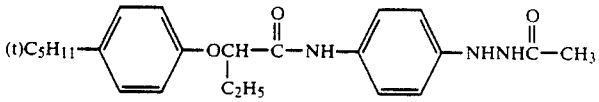
(I-25)
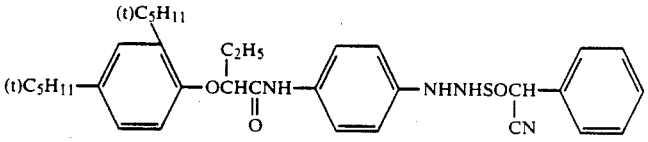
(I-26)
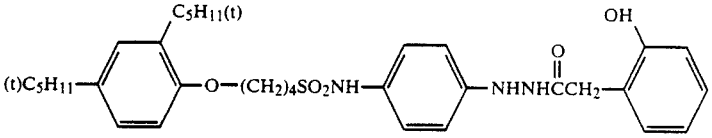
(I-27)
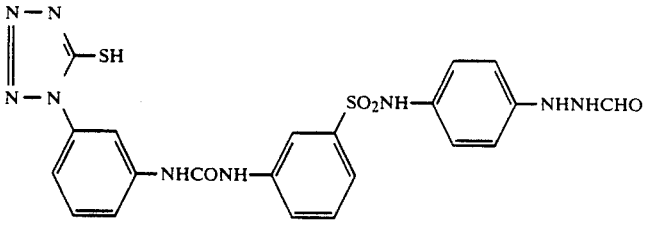
(I-28)
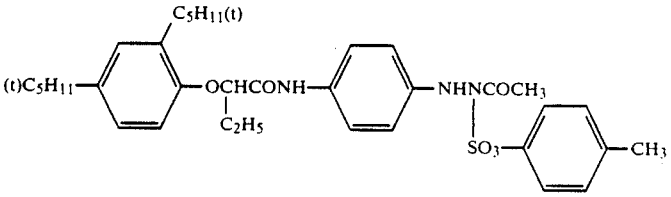
(I-29)
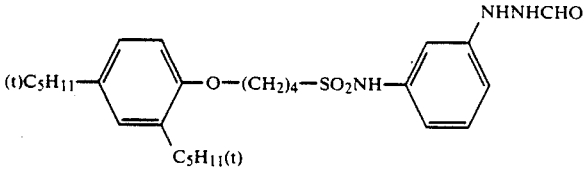

-continued
(I-30)
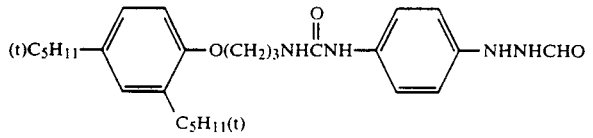
(I-31)
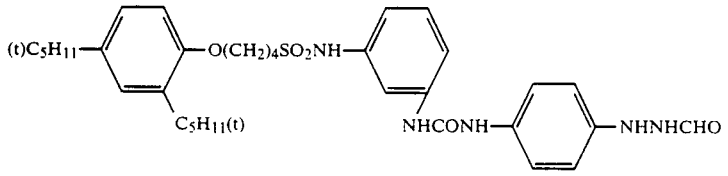
(I-32)
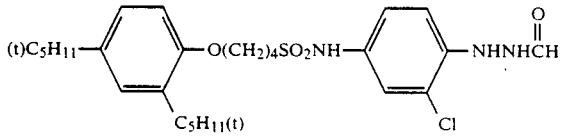
(I-33)
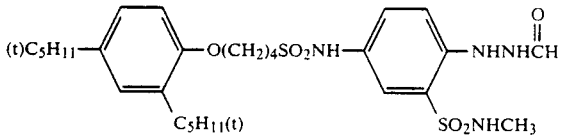
(I-34)
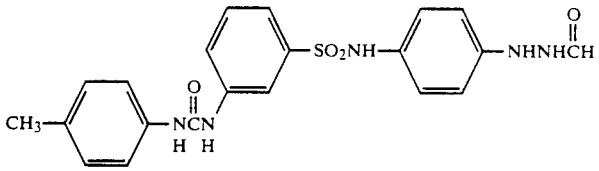
(I-35)
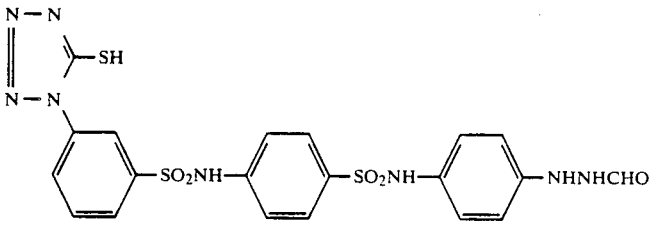
(I-36)
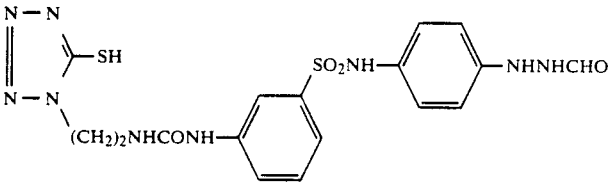
(I-37)
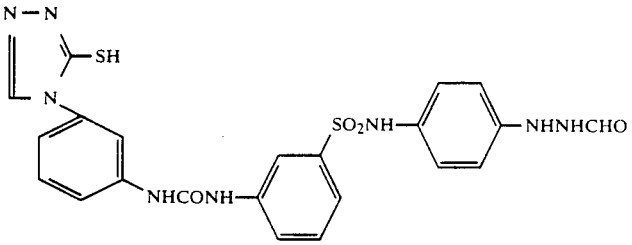

-continued
(I-38)
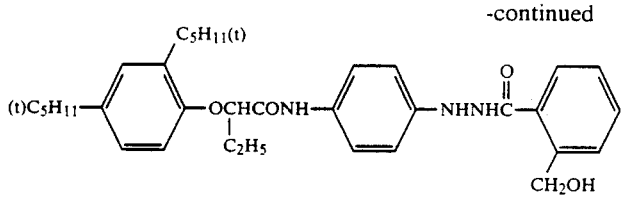
(I-39)
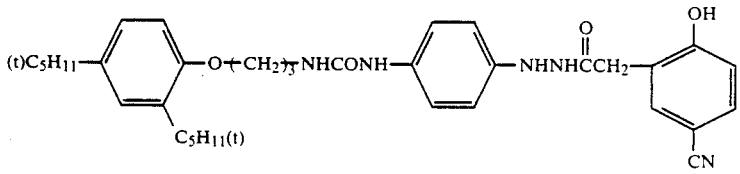
(I-40)
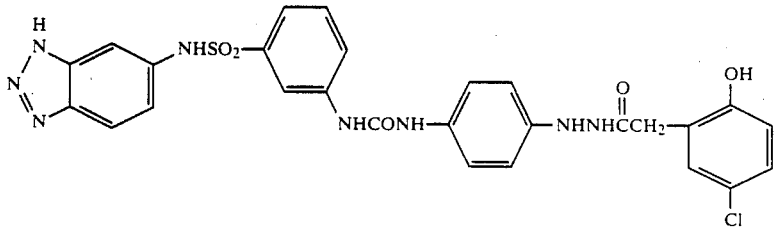
(I-41)
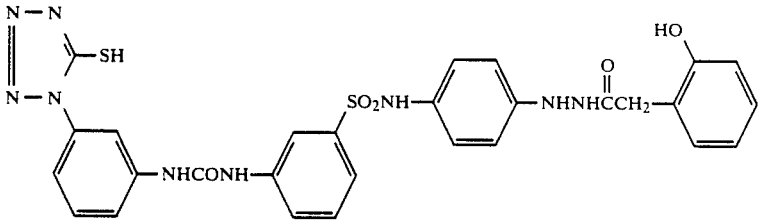
(I-42)
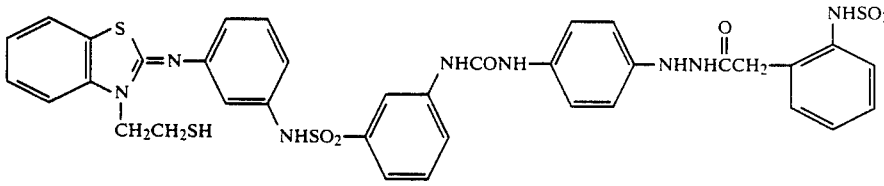
(I-43)
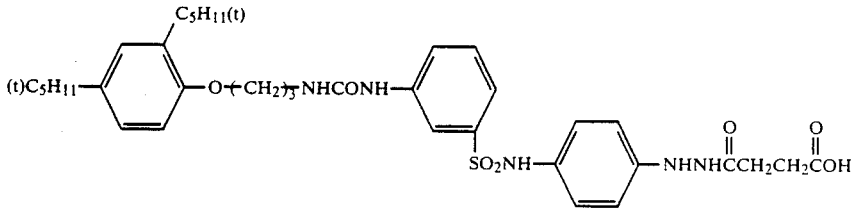
(I-44)
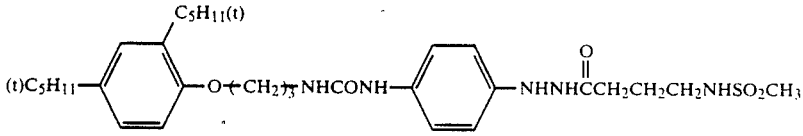
(I-45)
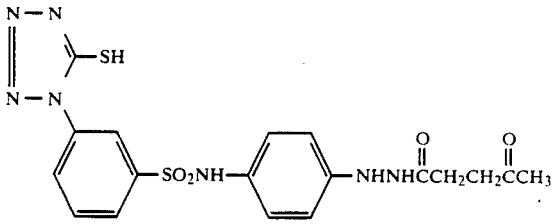
As the hydrazine derivatives for use in the present invention, there are further mentioned, in addition to The amount of the hydrazine derivative to be added to the photographic material of the present invention is preferably from $1\times10^{-6}$ to $5\times10^{-2}$ mol, and especially preferably from $1\times10^{-5}$ to $1\times10^{-2}$ mol, per mol of silver halide.

The silver halide emulsion for use in preparing the photographic material of the present invention may be any one of silver chloride, silver chlorobromide, silver iodobromide or silver iodochlorobromide.

However, for the purpose of forming the contact work silver halide photographic material which may be processed under a bright room condition, the composition of the silver halide emulsion desirably has a relatively low sensitivity, especially to visible rays. Accordingly, a silver chloride emulsion or a silver chlorobromide emulsion having a silver chloride content of 80 mol % or more is preferably used in accordance with the present invention.

The silver halide grains for use in the present invention are desirably fine grains having a mean grain size of, for example, 0.7 μm or less, more preferably 0.5 μm or less, and most preferably from 0.3 μm to 0.05 μm. The grain size distribution of the grains is not specifically limitative, but the emulsion is preferably a monodispersed one. The "monodispersed emulsion" as referred to herein means that at least 90%, more preferably at least 95%, by weight or by number of the grains in the emulsion have a grain size within ±40% of the mean grain size.

The silver halide grains in the photographic emulsion may be regular crystals such as cubic or octahedral crystals or may also be irregular crystals such as spherical or tabular crystals. In addition, they may be composite crystals composed of different crystal forms.

The silver halide grains may have a uniform phase in both the inside and the surface layer thereof, or they may be composed of different phases therebetween. Two or more different silver halide emulsions which were separately prepared can be mixed for use in the present invention.

In the step of forming the silver halide emulsion for use in the present invention or of physically ripening the same, a cadmium salt, a sulfite salt, a lead salt, a thallium salt, a rhodium salt or a complex salt thereof, or an iridium salt or a complex salt thereof may be incorporated into the reaction system.

The silver halide emulsion for use in the present invention may be or may not be chemically sensitized. As the means of chemically sensitizing silver halide emulsions, sulfur sensitization, reduction sensitization and noble metal sensitization are known, and any of them may be applied to the emulsion for use in the present invention. Such means may be employed singly or in combination.

For forming the silver halide grains for use in the present invention by reacting a soluble silver salt and soluble halide(s), a single jet method, a double jet method or a combination thereof may be employed. As one system of the double jet method, a so-called controlled double jet method where the pAg value in the liquid phase of forming silver halide grains is kept constant may be employed, whereby a silver halide emulsion having a regular crystalline form and having an almost uniform grain size can be obtained.

In the step of forming the silver halide grains of the emulsion for use in the present invention or of physically ripening the same, a rhodium salt or a complex salt thereof, or an iridium salt or a complex salt thereof may be incorporated into the reaction system, whereby the sensitivity or gradation of the resulting emulsion may well be controlled.

The amount of the rhodium salt or complex salt thereof to be used for the above purpose is from $1\times10^{-8}$ to $1\times10^{-3}$ mol, and preferably from $5\times10^{-7}$ to $5\times10^{-4}$ mol, per mol of silver. Specifically, rhodium dichloride, rhodium trichloride, potassium hexachlororhodate(III) and ammonium hexachlororhodate(III) can be used.

The amount of the iridium salt or complex salt thereof to be used for the above purpose is from $1\times10^{-8}$ to $1\times10^{-4}$ mol, and preferably from $5\times10^{-7}$ to $1\times10^{-5}$ mol, per mol of silver. Specifically, iridium trichloride, iridium tetrachloride, potassium hexachloroiridate(III), potassium hexabromoiridate(III) and ammonium hexachloroiridate(III) can be used.

The photographic material of the present invention can contain a water-soluble dye which absorbs light of a specific wavelength, for the purpose of improving the processability in a bright room and of preventing halation and irradiation of the material.

Such dye includes oxonol dyes, merocyanine dyes, cyanine dyes, azo dyes and benzilidene dyes.

Specific examples of the dyes are described in British Patents 584,609 and 1,177,429, JP-A-48-85130, JP-A-49-79620, JP-A-49-114420, JP-A-52-20822, JP-A-59-154439, JP-A-59-208548, U.S. Pat. Nos. 2,274,782, 2,533,472, 2,956,879, 3,148,187, 3,177,078, 3,247,127, 3,540,887, 3,575,704, 3,653,905 and 3,718,472.

The photographic material of the present invention can contain a desensitizing dye and an ultraviolet absorbent so as to attain the intended sensitivity and the safelight stability.

The technique of the present invention is especially advantageously applied to bright room type silver halide photographic materials having high contrast photographic characteristics, since such materials often have noticeable pinholes after being processed.

As the binder or protective colloid for the photographic emulsion, gelatin is advantageously used. However, any other hydrophilic colloid may also be used. For instance, hydrophilic colloids usable for the above purpose include proteins such as gelatin derivatives, graft polymers of gelatin and another high polymer substance, albumin, casein; cellulose derivatives such as hydroxyethyl cellulose, carboxymethyl cellulose, cellulose sulfate; saccharide derivatives such as sodium alginate, starch derivatives; and other various kinds of synthetic hydrophilic high polymer substances of homopolymers or copolymers such as polyvinyl alcohol, polyvinyl alcohol partial acetal, poly-N-vinyl pyrrolidone, polyacrylic acid, polymethacrylic acid, polyacrylamide, polyvinyl imidazole, polyvinyl pyrazole.

As gelatin, lime-processed gelatin as well as acid-processed gelatin may be used. Further, gelatin hydrolysate and enzyme-decomposed products of gelatin can also be used. Examples of such gelatin substances are described in *Research Disclosure*, Vol. 176, Item No. 17643 (December, 1978), Item IX.

Known spectral sensitizing dyes may be added to the silver halide emulsion layers for use in the present invention.

The photographic emulsions for use in the present invention can contain various compounds for the purpose of preventing fogging during the manufacture step, storage or processing step of photographic material and of stabilizing the photographic property of the material. Specifically, the material can contain various compounds which are known as an antifoggant or stabilizer, for example, azoles such as benzothiazolium salts, nitroindazoles, triazoles or benzotriazoles; benzimidazoles (especially nitro- or halogen-substituted benzimidazoles such as chlorobenzimidazoles or bromobenzimidazoles); heterocyclic mercapto compounds such as mercaptothiazoles, mercaptobenzothiazoles, mercaptobenzimidazoles, mercaptothiadiazoles, mercaptotetrazoles (especially 1-phenyl-5-mercaptotetrazole), mercaptopyrimidines; aminotriazoles; benzothiazoles; nitrobenzotriazoles; mercaptotriazines; the above-mentioned heterocyclic mercapto compounds having a water-soluble group such as a carboxyl or sulfone group; thioketo compounds such as oxazolinethione; azaindenes, such as triazaindenes, tetraazaindenes (especially 4-hydroxy-substituted (1,3,3a,7)tetraazaindenes), pentaazaindenes; and benzenethiosulfonic acid; benzenesulfinic acid; benzenesulfonic acid amide; hydroquinone derivatives; oximes or aldoximes. Among these compounds, especially preferred are benzotriazoles (for example, 5-methylbenzotriazole), nitroindazoles (for example, 5-nitroindazole) and hydroquinone derivatives (for example, hydroquinone, methylhydroquinone). These compounds can be incorporated into processing solutions.

The photographic material of the present invention can contain an inorganic or organic hardening agent in the photographic emulsion layer or in any other hydrophilic colloid layer. For instance, such hardening agent includes chromium salts (e.g., chromium alum, chromium acetate), aldehydes (e.g., formaldehyde, glyoxal, glutaraldehyde), n-methylol compounds (dimethylolurea, methyloldimethylhydantoin), dioxane derivatives (e.g., 2,3-dihydroxydioxane), active vinyl compounds (e.g., 1,3,5-triacryloyl-hexahydro-s-triazine, 1,3-vinylsulfonyl-2-propanol), active halogen compounds (e.g., 2,4-dichloro-6-hydroxy-s-triazine), mucohalogenic acids (e.g., mucochloric acid, mucophenoxychloric acid), N-carbamoylpyridinium salts and haloamidinium salts. These can be used singly or in combination. Above all, active vinyl compounds described in JP-A-53-41221, JP-A-53-57257, JP-A-59-162546 and JP-A-60-80846 and active halides described in U.S. Pat. No. 3,325,287 are preferred.

The photographic material of the present invention can contain various kinds of surfactants in the photographic emulsion layer or in any other hydrophilic colloid layer for the purpose of use as a coating aid and as an antistatic agent, for improvement of slide property, for improvement of emulsification and dispersion, for prevention of adhesion and for improvement of photographic characteristics (for example, development acceleration, increase in contrast and increase in sensitization).

Surfactants usable for the above purpose include, for example, nonionic surfactants, such as saponins (steroid type), alkylene oxide derivatives (e.g., polyethylene glycol, polyethylene glycol/polypropylene glycol condensation products, polyethylene glycol alkyl ethers, polyethylene glycol alkylaryl ethers, polyethylene glycol esters, polyethylene glycol sorbitan esters, polyalkylene glycol alkylamines or amides, silicone/polyethylene oxide adducts), glycidol derivatives (e.g., alkenylsuccinic acid polyglycerides, alkylphenol polyglycerides), fatty acid esters of polyhydric alcohols, alkyl esters of saccharides; anionic surfactants containing an acidic group such as a carboxyl group, a sulfo group, a phospho group, a sulfuric acid group or a phosphoric acid group, for example, alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters; amphoteric surfactants, such as amino acids, aminoalkylsulfonic acids, aminoalkylsulfuric acid or phosphoric acid esters, alkylbetaines, amine oxides; and cationic surfactants, such as alkylamine salts, aliphatic or aromatic quaternary ammonium salts, heterocyclic quaternary ammonium salts (e.g., pyridinium or imidazolium salts), and aliphatic or heterocyclic phosphonium or sulfonium salts.

Surfactants which are preferably used in the present invention are polyalkylene oxides having a molecular weight of 600 or more, described in JP-B-58-8412. In addition, a polymer latex such as polyalkyl acrylate may also be incorporated into the photographic material of the present invention for the purpose of improving the dimensional stability of the material.

Further, spherical grains such as polymethyl methacrylate grains as well as amorphous grains such as silica, magnesium oxide or silicon dioxide may also be incorporated into the photographic material of the present invention as a matting agent, for the purpose of preventing adhesion of the materials and of improving the writability (printability) and vacuum adhesive property of the material. The matting agent grains generally has a mean grain size of from 0.1 $\mu$m to 10 $\mu$m, and preferably from 1 to 5 $\mu$m.

As the support for the photographic material of the present invention, cellulose triacetate, cellulose diacetate, nitrocellulose, polystyrene or polyethylene terephthalate can be used.

As the development accelerator or nucleating infectious development accelerator which is suitably used for processing the photographic material of the present invention, there are mentioned the compounds described in JP-A-53-77616, JP-A-54-37732, JP-A-53-137133, JP-A-60-140340 and JP-A-60-14959 as well as other various nitrogen- or sulfur-containing compounds.

The photographic material of the present invention can contain a dispersion of a water-soluble or sparingly soluble synthetic polymer for the purpose of improving the dimensional stability of the material. For instance, homopolymers or copolymers composed of monomers of alkyl (meth)acrylates, alkoxyalkyl (meth)acrylates or glycidyl (meth)acrylates, singly or in combination, or copolymers composed of the said monomers in combination with other monomers of acrylic acid or methacrylic acid can be used for the purpose.

The photographic material of the present invention can contain an acid group-containing compound in the silver halide emulsion layer or in any other layer. As the acid group-containing compound to be used, there are mentioned, for example, organic acids such as salicylic acid, acetic acid or ascorbic acid as well as polymers or copolymers composed of repeating acid monomer units of acrylic acid, maleic acid or phthalic acid. Regarding such compounds, the disclosures of JP-A-61-223834, JP-A-61-228437, JP-A-62-25745 and JP-A-62-55642 can be referred to. Of these compounds, especially preferred are ascorbic acid as a low molecular compound and a water-dispersed latex of a copolymer composed of an acid monomer (e.g., acrylic acid) and a crosslinking monomer having two or more unsaturated groups (e.g., divinylbenzene) as a high molecular compound.

The photographic material of the present invention may have, in addition to the silver halide emulsion layer and the metal oxide-containing electroconductive layer, other constitutional hydrophilic layers such as surface protective layers, interlayers, filter layers and antihalation layers.

The protective layer can contain, as a matting agent, fine grains (for example, having a grain size of from 2 to 5 μm) of polymethyl methacrylate described in U.S. Pat. Nos. 2,992,101, 2,701,245, 4,142,894 and 4,396,706; copolymer of methyl methacrylate and methacrylic acid; starch; or silica. In addition, the above-mentioned surfactant can also be used together with the matting agent.

The surface protective layer may also contain, as a sliding agent (e.g., lubricant), silicone compounds described in U.S. Pat. Nos. 3,489,576 and 4,047,958, or colloidal silica described in JP-B-56-23139 as well as paraffin wax, higher fatty acid esters and starch.

The hydrophilic colloid layer may contain, as a plasticizer, polyols such as trimethylolpropane, pentanediol, butanediol, ethylene glycol or glycerin.

As the support for the photographic material of the present invention, there are also mentioned a transparent or opaque synthetic resin film such as polyethylene terephthalate, cellulose acetate, polycarbonate, polystyrene or polypropylene, and a polyethylene resin-coated paper support.

When the silver halide photographic material of the present invention is processed to obtain a high contrast photographic characteristic, it is unnecessary to use a conventional infectious developer or a high alkali developer having a pH value of 13 or so described in U.S. Pat. No. 2,419,975 but any stable developer can be used.

That is, the silver halide photographic material of the present invention can be processed with a developer containing a sulfite ion of 0.15 mol/liter or more, as a preservative, and having a pH value of preferably from 10.5 to 12.3, especially preferably from 11.0 to 12.0, to obtain a sufficiently high contrast negative image.

The developing agent in the developer to be used for processing the photographic material of the present invention is not specifically limited but, for example, dihydroxybenzenes (e.g., hydroquinone), 3-pyrazolidones (e.g., 1-phenyl-3-pyrazolidone, 4,4-dimethyl-1-phenyl-3-pyrazolidone) and aminophenols (e.g., N-methyl-p-aminophenol) can be used singly or in combination.

The silver halide photographic material of the present invention is especially suitably processed with a developer containing a dihydroxybenzene compound as a main developing agent and a 3-pyrazolidone or aminophenol compound as an auxiliary developing agent. Preferably, the developer contains a dihydroxybenzene compound in an amount of from 0.05 to 0.5 mol/liter and a 3-pyrazolidone or aminophenol compound in an amount of 0.06 mol/liter or less.

The dihydroxybenzene developing agents for use in the present invention include, for example, hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, 2,5-dimethylhydroquinone; and hydroquinone is especially preferred among them.

As the developing agent of 1-phenyl-3-pyrazolidone or derivatives thereof for use in the present invention, there are mentioned 1-phenyl-3-pyrazolidone, 1-phenyl-4,4-dimethyl-3-pyrazolidone, 1--phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone and 1-p-tolyl-4-methyl-4-hydroxymethyl-3-pyrazolidone.

As the p-aminophenol developing agent for use in the present invention, there are mentioned N-methyl-p-aminophenol, p-aminophenol, n-(γ-hydroxyethyl)-p-aminophenol, N-(4-hydroxyphenyl)glycine, 2-methyl-p-aminophenol, p-benzylaminophenol; and N-methyl-p-aminophenol is preferred among them.

The amount of the developing agent to be used is preferably from 0.05 mol/liter to 0.8 mol/liter. When a combination of a dihydroxybenzene compound and a 1-phenyl-3-pyrazolidone or p-aminophenol is employed, the amount of the former is preferably from 0.05 mol/liter to 0.5 mol/liter, and that of the latter is preferably from 0.06 mol/liter or less.

As the sulfite preservative for use in the present invention, there are mentioned, for example, sodium sulfite, potassium sulfite, lithium sulfite, ammonium sulfite, sodium bisulfite, potassium metabisulfite and formaldehyde-sodium bisulfite. The sulfite preservative is preferably incorporated into the processing solution in an amount of 0.15 mol/liter or more, and especially 0.3 mol/liter or more. The upper limit thereof is preferably 2.5 mol/liter or less.

An alkali agent can be used for the purpose of adjusting the pH value of the processing solution, which may be, for example, a pH adjuster or buffer such as sodium hydroxide, potassium hydroxide, sodium carbonate, potassium carbonate, sodium tertiary phosphate, potassium tertiary phosphate, sodium silicate or potassium silicate.

In addition to the above-mentioned additives, the processing solution for use in processing the photographic material of the present invention can further contain a development inhibitor such as boric acid, borax, sodium bromide, potassium bromide or potassium iodide; an organic solvent such as ethylene glycol, diethylene glycol, triethylene glycol, dimethylformamide, methyl cellosolve, hexylene glycol, ethanol or methanol; as well as an antifoggant or black pepper inhibitor, for example, mercapto compounds such as 1-phenyl-5-mercaptotetrazole, sodium 2-mercaptobenzimidazole-5-sulfonate, indazole compounds such as 5-nitroindazole, triazole compounds such as 5-methylbenzotriazole, or benzimidazole compounds such as 5-nitrobenzimidazole.

Furthermore, the processing solution may additionally contain a color toning agent, a surfactant (e.g., polyalkylene oxides), a defoaming agent, a hard water softener, a hardening agent, as well as an amino compound described in JP-A-56-106244.

The developer for use in the present invention can contain the compounds described in JP-B-56-24347 as a silver stain inhibitor, the compounds described in JP-A-62-212651 (e.g., 2-mercaptobenzimidazole sulfonic acids) as a development unevenness inhibitor, and the compounds described in JP-A-61-267759 as a dissolution aid.

The developer for use in the present invention can contain, as a buffer, boric acids described in JP-A-62-186259, saccharides (e.g., saccharose), as well as oximes (e.g., acetoxime), phenols (e.g., 5-sulfosalicylic acid)

and tertiary phosphoric acid salts (e.g., sodium salt, potassium salt) described in JP-A-60-93433.

Amines may be added to the developer so as to elevate the developing speed and to shorten the developing time, as so described in U.S. Pat. No. 4,269,929.

On the other hand, the fixing solution to be used for processing the photographic material of the present invention is an aqueous solution containing a thiosulfate, a water-soluble aluminum compound, acetic acid or dibasic acid (e.g., tartaric acid, citric acid or a salt thereof). This has a pH value of generally 4.4 or more, preferably from 4.6 to 5.4, and more preferably from 4.6 to 5.0.

The pH value of the fixing solution has a great influence on the variation of the swelling degree of the film and thereby on the degree of the color retention therein. Specifically, if the pH value of the solution is higher than 5.4, the film would be swollen too much even if a prescribed hardening agent has been introduced into the film, and the thus-swollen film would cause drying failure or conveyance trouble (e.g., moving failure). If too much hardening agent is introduced into the film so as to prevent such trouble, the excess hardening agent would precipitate as a solid to cause stains in the film. On the other hand, however, if the pH value is less than 4.4, there is also another problem of color retention in the processed film. If the pH value is less than 4.0, there is still another problem of fixation insufficiency. Accordingly, the above-defined pH value range and the above-defined amount of the hardening agent according to the present invention are rather critical so as to obtain a processed film having little color retention by rapid processing.

The fixing agent contains as an essential component a thiosulfate such as sodium thiosulfate or ammonium thiosulfate. Ammonium thiosulfate is especially preferred from the viewpoint of rapid fixability. The amount of the fixing agent can properly be varied, and in general, it is from about 0.1 mol/liter to about 5 mol/liter.

As the acidic hardening agent to be contained in the fixing solution for use in the present invention, there may be mentioned, for example, a water-soluble aluminum salt or chromium salt as well as an ethylenediaminetetraacetic acid complex with an oxidizing agent of a trivalent iron compound. Of these compounds, preferred are water-soluble aluminum compounds, for example, aluminum chloride, aluminum sulfate and potassium alum. The amount of the compound to be added is preferably from 0.01 to 0.2 mol/liter, more preferably from 0.03 to 0.08 mol/liter.

As the dibasic acid, tartaric acid or derivatives thereof and citric acid or derivatives thereof can be used singly or in combination of two or more of them. The compound may be added to the fixing solution, effectively in an amount of 0.005 mol/liter or more, and especially effectively in an amount of from 0.01 mol/liter to 0.03 mol/liter. Specifically, there are mentioned tartaric acid, potassium tartarate, sodium tartarate, potassium hydrogen tartarate, sodium hydrogen tartarate, sodium potassium tartarate, ammonium tartarate, potassium ammonium tartarate, potassium aluminum tartarate, potassium antimonyl tartarate, sodium antimonyl tartarate, lithium hydrogen tartarate, lithium tartarate, magnesium hydrogen tartarate, potassium boron tartarate and potassium lithium tartarate. As examples of citric acid and derivatives thereof which are effectively used in the present invention, there are citric acid, sodium citrate, potassium citrate, lithium citrate and ammonium citrate. The fixing solution can contain, if desired, a preservative (e.g., sulfites, bisulfites), a pH buffer (e.g., acetic acid, boric acid), a pH adjuster (e.g., sulfuric acid) and a chelating agent (mentioned above). The pH buffer is incorporated into the fixing solution in an amount of generally from about 10 to about 40 g/liter, and preferably from about 18 to about 25 g/liter, as the pH value of the developer is high.

The fixing temperature and time may be the same as those in development. For example, the temperature is preferably from about 20° C. to about 50° C.; and the time is preferably from 10 seconds to 1 minute.

In accordance with the present invention, the photographic material is, after being developed and fixed, rinsed with water and then dried. Rinsing is effected so as to almost completely remove the silver salt as dissolved out by fixation, and it is preferably carried out at from about 20° C. to about 50° C. and for 10 seconds to 3 minutes. Drying may be carried out at from about 40° C. to about 100° C., and the drying time can be varied in accordance with the ambient state. Generally, the time may be from about 5 seconds to about 3 minutes and 30 seconds.

The photographic material of the present invention can be processed with a roller conveyance type automatic developing machine, which is described in detail in U.S. Pat. Nos. 3,025,779 and 3,545,971. The machine may be referred to as "roller conveyance type processor". The roller conveyance type processor comprises four steps of development, fixation, rinsing and drying. In accordance with the present invention, the photographic material is preferably processed by the four steps in order, although the processing procedure may also contain any other additional step (such as stopping step).

The development temperature and the fixation temperature can be selected from the range of generally from 18° C. to 50° C., preferably from 20° C. to 50° C., and more preferably from 25° C. to 43° C., most preferably from 30° C. to 40° C.

The photographic material of the present invention is especially suitable to be processed by a rapid processing procedure with an automatic developing machine. As the type of the automatic developing machine, any one of roller conveyance type or belt conveyance type can be used. The processing time may be short, and the total processing time may be generally 2 minutes or less, preferably 100 seconds or less, more preferably from 15 seconds to 60 seconds. In the total processing time, the share for development is from 15 seconds to 60 seconds, that for fixation is from 10 seconds to 40 seconds, and that for rinsing is from 10 seconds to 60 seconds. Even in such rapid processing, the effect of the present invention can satisfactorily be attained.

The developer for use in the present invention can contain the compounds described in JP-A-56-24347 as a silver stain inhibitor. The compounds described in JP-A-61-267759 can be incorporated into the developer as a dissolution aid. Further, the compounds described in JP-A-60-93433 as well as the compounds described in JP-A-62-186256 can also be incorporated into the developer as a pH buffer.

In accordance with the present invention, silver halide photographic materials which may form an high contrast photographic image and which hardly have pinholes after being processed can be provided, and the photographic materials can well be processed with a stable developer.

The present invention will be explained in detail with reference to the following examples, which, however, are not intended to restrict the scope of the present invention.

The following developer and fixing solution were used in the examples.

| | | |
|---|---|---|
| Developer: | | |
| Hydroquinone | 50.0 | g |
| N-Methyl-p-aminophenol | 0.3 | g |
| Sodium Hydroxide | 18.0 | g |
| 5-Sulfosalicylic Acid | 55.0 | g |
| Potassium Sulfite | 110.0 | g |
| Disodium Ethylenediaminetetraacetate | 1.0 | g |
| Potassium Bromide | 10.0 | g |
| 5-Methylbenzotriazole | 0.4 | g |
| 2-Mercaptobenzimidazole-5-sulfonic Acid | 0.3 | g |
| Sodium 3-(5-Mercaptotetrazole)-benzenesulfonate | 0.2 | g |
| N-n-Butyldiethanolamine | 15.0 | g |
| Sodium Toluenesulfonate | 8.0 | g |
| Water to make | 1 | liter |
| Potassium Hydroxide to make pH of | 11.6 | |
| Hardening Fixing Agent: | | |
| Ammonium Thiosulfate | 180 | g |
| Sodium Thiosulfate Pentahydrate | 45 | g |
| Sodium Sulfite | 18 | g |
| Nitrilotriacetic Acid | 0.4 | g |
| Tartaric Acid | 4.0 | g |
| Glacial Acetic Acid | 30.0 | g |
| Aluminum Sulfate | 11.0 | g |
| Water to make | 1 | liter |
| Ammonia to make pH of | 4.7 | |

EXAMPLE I-1

A subbing layer comprising 14 mg/m$^2$ of gelatin and 9 mg/m$^2$ of a reaction product of polyamide (made of diethylenetriamine and adipic acid) and epichlorohydrin was coated on both surfaces of a biaxially oriented polyethylene terephthalate support having a thickness of 100 μm. Next, an electroconductive layer composed of the following Composition (1) and a gelatin layer composed of the following Composition (2) were coated on the both surfaces or one surface of the support, as indicated in Table I-1 below. Further, Silver Halide Emulsion Layers (1) and (2) and Protective Layers (1) and (2) each composed of the following Compositions (3), (4), (5) and (6), respectively, were coated on one surface of the support, while a backing layer composed of the following Composition (7) and Protective Layer (3) composed of the following Composition (8), respectively, were coated on the other surface thereof (on the opposite surface). After being dried, samples were prepared.

Composition (1)

| Electroconductive Layer | |
|---|---|
| $SnO_2$/Sb (9/1 by weight, mean grain size: 0.25 μm) | 165 mg/m$^2$ |
| Gelatin | 19 mg/m$^2$ |

Composition (2)

| Gelatin Layer | |
|---|---|
| Gelatin | 35 mg/m$^2$ |
| Salicylic Acid | 17 mg/m$^2$ |
| Reaction Product of Polyamide (made of diethylenetriamine and adipic acid) and Epichlorohydrin | 6 mg/m$^2$ |

Composition (3)

| Silver Halide Emulsion Layer (1) | |
|---|---|
| Solution I: | Water (300 ml), Gelatin (9 g) |
| Solution II: | $AgNO_2$ (100 g), Water (400 ml) |
| Solution III: | NaCl (37 g), $(NH_4)_3RhCl$ (1.1 mg), Water (400 ml) |

Solution II and Solution III were simultaneously added to Solution I kept at 45° C. at a determined rate. The soluble salts were removed from the resulting emulsion by a well known method (for example, flocculation method). Gelatin was added and then 6-methyl-4-hydroxy-1,3,3a,7-tetraazaindene was added thereto as a stabilizing agent. The emulsion was a monodispersed emulsion having a mean grain size of 0.20 μm, and the content of gelatin therein was 60 g per 1 kg of the total emulsion.

To the emulsion thus-prepared were added the following compounds:

| | |
|---|---|
| Compound I-30 of the Present Invention | $5 \times 10^{-3}$ mol/mol of Ag |
| Compound-1 | 60 mg/m$^2$ |
| Compound-2 | 9 mg/m$^2$ |
| Sodium Polystyrenesulfonate | 40 mg/m$^2$ |
| Sodium N-Oleoyl-N-methyltaurine | 50 mg/m$^2$ |
| 1,2-Bis(vinylsulfonylacetamido)-ethane | 70 mg/m$^2$ |
| 1-Phenyl-5-mercaptotetrazole | 3 mg/m$^2$ |
| Ethyl Acrylate Latex (mean grain size: 0.05 μm) | 0.46 g/m$^2$ |

The coating composition thus-obtained was coated on the support in an amount of 2 g/m$^2$ as silver.

Compound-1 and Compound-2 were as follows:

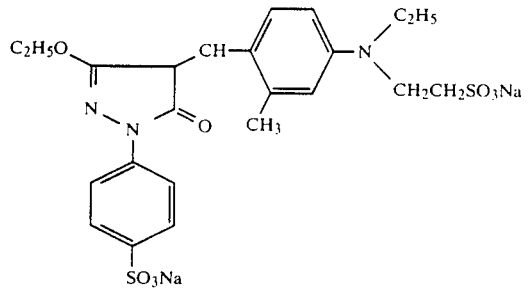

Compound-1

-continued

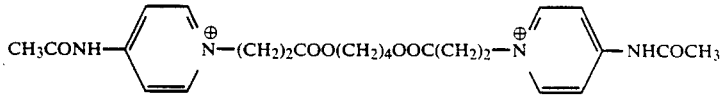

Compound-2

Composition (4)

| Silver Halide Emulsion Layer (2) | |
|---|---|
| Solution I: | Water (300 ml), Gelatin (9 g) |
| Solution II: | $AgNO_3$ (100 g), Water (400 ml) |
| Solution III: | NaCl (37 g), $(NH_3)RhCl_6$ (2.2 mg), Water (400 ml) |

In accordance with the same manner as the emulsion of Composition (3), Solution II and Solution III were simultaneously added to Solution I to prepare an emulsion. This was monodispersed emulsion having a mean grain size of 0.20 μm.

To the emulsion thus-obtained were added the following compounds:

| | |
|---|---|
| Compound I-30 of the Present Invention | $5 \times 10^{-3}$ mol/mol of Ag |
| Compound-1 | 60 mg/m$^2$ |
| Compound-2 | 9 mg/m$^2$ |
| Sodium Polystyrenesulfonate | 50 mg/m$^2$ |
| Sodium N-Oleoyl-N-methyltaurine | 40 mg/m$^2$ |
| 1,2-Bis(vinylsulfonylacetamido)-ethane | 80 mg/m$^2$ |
| 1-Phenyl-5-mercaptotetrazole | 3 mg/m$^2$ |
| Ethyl Acrylate Latex (mean grain size: 0.05 μm) | 0.4 g/m$^2$ |

The coating composition thus-obtained was coated on the support in an amount of 2 g/m$^2$ as silver.

Composition (5)

| | |
|---|---|
| Gelatin | 1.0 g/m$^2$ |
| Lipoic Acid | 5 mg/m$^2$ |
| Sodium Dodecylbenzenesulfonate | 5 mg/m$^2$ |
| Compound-3 | 20 mg/m$^2$ |

-continued

| | |
|---|---|
| Sodium Polystyrenesulfonate | 10 mg/m$^2$ |
| Compound-4 | 20 mg/m$^2$ |
| Ethyl Acrylate Latex (mean grain size: 0.05 μm) | 200 mg/m$^2$ |

Composition (6)

| Protective Layer (2) | |
|---|---|
| Gelatin | 1.0 g/m$^2$ |
| Fine Polymethyl Methacrylate Grains (mean grain size: 2.5 μm) | 60 mg/m$^2$ |
| Sodium Dodecylbenzenesulfonate | 20 mg/m$^2$ |
| Potassium N-Perfluorooctanesulfonyl-N-propylglycine | 3 mg/m$^2$ |
| Sodium Polystyrenesulfonate | 2 mg/m$^2$ |
| Sodium Salt of Sulfuric Acid Ester of Poly(polymerization degree: 5)-oxyethylene-nonylphenyl Ether | 20 mg/m$^2$ |

Compound-3and Compound-4were as follows:

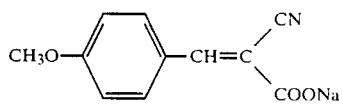

Compound-3

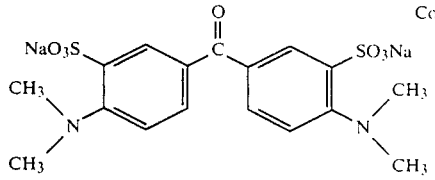

Compound-4

Composition (7)

| Backing Layer | |
|---|---|
| Gelatin | 2.5 g/m$^2$ |
| Compound-5 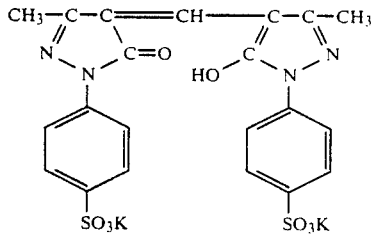 | 300 mg/m$^2$ |
| Compound-6 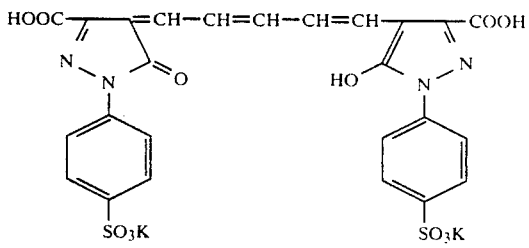 | 50 mg/m$^2$ |

-continued

| Backing Layer | |
|---|---|
| Compound-7 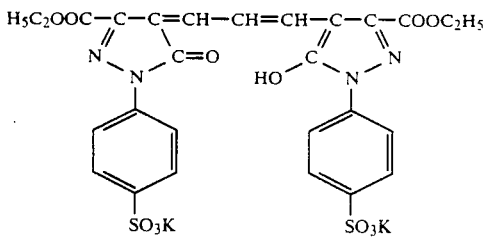 | 50 mg/m$^2$ |
| Sodium Dodecylbenzenesulfonate | 50 mg/m$^2$ |
| Sodium Dihexyl-α-sulfosuccinate | 20 mg/m$^2$ |
| Sodium Polystyrenesulfonate | 40 mg/m$^2$ |
| 1,3-Divinylsulfonyl-2-propanol | 150 mg/m$^2$ |
| Ethyl Acrylate Latex (mean grain size: 0.05 μm) | 500 mg/m$^2$ |

Composition (8)

| Protective Layer (3) | |
|---|---|
| Gelatin | 1 g/m$^2$ |
| Fine Polymethyl Methacrylate Grains (mean grain size: 3.4 μm) | 40 mg/m$^2$ |
| Sodium Dodecylbenzenesulfonate | 15 mg/m$^2$ |
| Sodium Dihexyl-α-sulfosuccinate | 10 mg/m$^2$ |
| Sodium Polystyrenesulfonate | 20 mg/m$^2$ |
| Sodium Acetate | 40 mg/m$^2$ |

Samples thus prepared were rubbed with a neoprene rubber roller in a general room (25° C., 25% RH) which was not specifically air-conditioned and then exposed and developed (38° C., 20 seconds). The surfaces of the samples were evaluated with respect to the degree of pinholes formed.

For measurement of the surface resistivity, the sample was, after allowed to stand under the condition of 25° C. and 25% RH for 12 hours, put between two brass electrodes (length: 10 cm) with a distance of 0.14 cm therebetween (the part of the electrode to be contacted with the sample was made of a stainless steel), and the resistivity value was measured after 1 minute with Electrometer TR8651 (manufactured by Takeda Riken Co., Japan).

The results obtained are shown in Table I-1 below. As is obvious from the results therein, Samples I-1 to I-3 of the present invention had noticeably reduced pinholes as compared with Comparative Sample I-4.

TABLE I-1

| Sample No. | Electroconductive Layer* (coated position) | Degree of Pinholes** |
|---|---|---|
| I-1 (Invention) | One Surface (on backing layer) | 7 |
| I-2 (Invention) | One Surface (on emulsion layer) | 7 |
| I-3 (Invention) | Both Surfaces (on backing layer and emulsion layer) | 5 |
| I-4 (Comparison) | — | 100 |

Notes:
*Surface resistivity of electroconductive layer (25° C., 25% RH): $2 \cdot 10^8$ Ω
**The value means a relative value on the basis of the degree of pinholes of Comparative Sample I-4 of being 100.

EXAMPLES I-2

Samples I-5, I-6 and I-7 were prepared in the same manner as Sample I-1 of Example I-1, except that the ratio of electroconductive metal oxide to gelatin in the electroconductive layer was varied as indicated in Table I-2 below. These samples were tested in the same manner as in Example 1, and the degree of pinholes formed was evaluated. The results obtained are shown in Table I-2.

As is apparent from the results in Table I-2, Samples I-5 to I-7 of the present invention each having a surface resistivity of $1 \times 10^{12}$Ω or less had extremely reduced pinholes as compared with Sample I-8 (Comparison).

TABLE I-2

| Sample No. | Electroconductive layer $SnO_2$/sd (mg/m$^2$) | Electroconductive layer Gelatin (mg/m$^2$) | Surface Resistivity (25° C., 25% RH) (Ω) | Degree of Pinholes |
|---|---|---|---|---|
| I-5 (Invention) | 165 | 19 | $2 \cdot 10^8$ | 6 |
| I-6 (Invention) | " | 40 | $6 \cdot 10^{10}$ | 10 |
| I-7 (Invention) | " | 90 | $4 \cdot 10^{11}$ | 13 |
| I-8 (Comparison) | — | 90 | $5 \cdot 10^{14}$ | 100 |

EXAMPLE I-3

Samples I-9 to I-12 were prepared in the same manner as in Example I-2, except that the electroconductive layer as indicated in Table I-3 below was coated. The samples were tested in the same manner as in Example I-1, and the degree of pinholes formed was evaluated. The results are shown in Table I-3 below. As is apparent from the results therein, Samples I-9 to I-12 of the present invention had extremely reduced pinholes as compared with Sample I-13 (Comparison).

TABLE I-3

| Sample No. | Electroconductive Layer High Polymer Compound | Electroconductive Layer Gelatin (g/m$^2$) | Surface Resistivity (25° C., 25% RH) (Ω) | Degree of Pinholes |
|---|---|---|---|---|
| I-9 (Invention) | P-6, 0.5 g/m$^2$ | 0.5 | $5.2 \cdot 10^{11}$ | 11 |
| I-10 (Invention) | P-5, 0.5 g/m$^2$ | " | $4.7 \cdot 10^{11}$ | 10 |
| I-11 | P-4, 0.5 g/m$^2$ | " | $3.4 \cdot 10^{11}$ | 10 |

TABLE I-3-continued

| Sample No. | Electroconductive Layer: High Polymer Compound | Electroconductive Layer: Gelatin ($g/m^2$) | Surface Resistivity (25° C., 25% RH) (Ω) | Degree of Pinholes |
|---|---|---|---|---|
| (Invention) I-12 | P-3, 0.5 $g/m^2$ | " | $7.1 \times 10^{11}$ | 13 |
| (Invention) I-13 (Comparison) | — | " | $5.2 \times 10^{14}$ | 100 |

EXAMPLE I-4

A backing layer comprising Composition (12) and Protective Layer (3) comprising Composition (13), respectively, were coated on a support having the same electroconductive layer as that in Sample No. I-5 or I-10, on the side of the said electroconductive layer. Further, on the opposite surface of the thus coated support, a silver halide emulsion layer comprising the following Composition (9) was coated in an amount of 3.5 $g/m^2$ as silver, and Protective Layers (1) and (2) each comprising Composition (10) and Composition (11), respectively, were further coated thereover. The samples thus-prepared were tested in the same manner as in Example I-1 with respect to the degree of pinholes formed. As a result, it was found that the samples of the present invention had noticeably reduced pinholes as compared with the comparative sample having no electroconductive layer.

Composition (9)

| Silver Halide Emulsion Layer | |
|---|---|
| Solution I: | Water (300 ml), Gelatin (7.2 g) |
| Solution II: | $AgNO_3$ (100 g), Water (400 ml) |
| Solution III: | KBr (69.7 g), KI (0.49 g), $K_3IrCl_6$ (0.123 mg), Water (500 ml) |

Solution II and Solution III were simultaneously added to Solution I kept at 50° C. at a determined rate. The soluble salts were removed from the resulting emulsion by a well known method. Gelatin was added thereto. The emulsion was a monodispersed emulsion having a mean grain size of 0.28 μm, and the content of gelatin therein was 56 g per 1 kg of the total emulsion.

The following compounds were added to the thus-prepared emulsion.

| | |
|---|---|
| 5,5'-Dichloro-9-ethyl-3,3'-bis(3-sulfopropyl)oxacarbocyanine Sodium Salt | 11 $mg/m^2$ |
| 3-(3-Sulfopropyl)-3'-(4-sulfobutyl)-5'-phenyl-4,5-dibenzoxacyanine Sodium Salt | 6.9 $mg/m^2$ |
| 6-Methyl-4-hydroxy-1,3,3a,7-tetraazaindene | 8 $mg/m^2$ |
| 5-Methylbenzotriazole | 17 $mg/m^2$ |
| Compound-2 of Example I-1 | 5 $mg/m^2$ |
| Compound (I-5) of the Invention | $1.2 \times 10^{-3}$ mol/mol of Ag |
| Compound (I-19) of the Invention | $5 \times 10^{-3}$ mol/mol of Ag |
| Polymer Latex | 195 $mg/m^2$ |

-continued

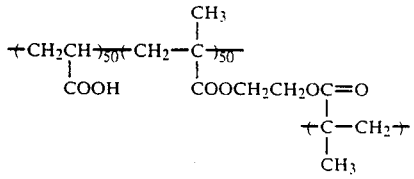

| | |
|---|---|
| Ethyl Acrylate Latex (mean grain size: 0.05 μm) | 600 $mg/m^2$ |
| 1,2-Bis(vinylsulfonylacetamido)-ethane | 140 $mg/m^2$ |
| N-Oleoyl-N-methyltaurine Sodium Salt | 40 $mg/m^2$ |
| Sodium Polystyrenesulfonate | 20 $mg/m^2$ |

Composition (10)

| Protective Layer (1) | |
|---|---|
| Gelatin | 1.0 $g/m^2$ |
| Ascorbic Acid | 30 $mg/m^2$ |
| Hydroquinone | 190 $mg/m^2$ |
| Ethyl Acrylate Latex (mean grain size: 0.05 μm) | 240 $mg/m^2$ |
| Sodium Polystyrenesulfonate | 3 $mg/m^2$ |
| 2,4-Dichloro-6-hydroxy-1,3,5-triazine Sodium Salt | 12 $mg/m^2$ |

Composition (11)

| Protective Layer (2) | |
|---|---|
| Gelatin | 0.6 $g/m^2$ |
| Fine Polymethyl Methacrylate Grains (mean grain size: 2.5 μm) | 60 $mg/m^2$ |
| Liquid Organopolysiloxane | 10 $mg/m^2$ |
| Sodium Dodecylbenzenesulfonate | 20 $mg/m^2$ |
| Potassium N-Perfluorooctanesulfonyl-N-propylglycine | 4 $mg/m^2$ |
| Colloidal Silica | 90 $mg/m^2$ |

Composition (12)

| Backing Layer | |
|---|---|
| Gelatin | 3 $g/m^2$ |
| Compound-8 | 40 $mg/m^2$ |

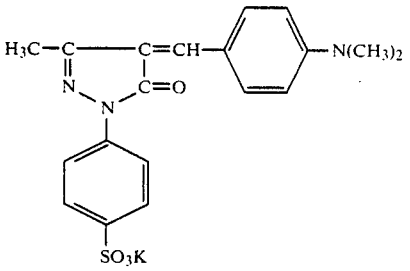

| | |
|---|---|
| Compound-5 | 120 $mg/m^2$ |
| Compound-6 | 40 $mg/m^2$ |
| Compound-7 | 30 $mg/m^2$ |
| Sodium Dihexyl-α-sulfosuccinate | 40 $mg/m^2$ |
| Sodium Dodecylbenzenesulfonate | 40 $mg/m^2$ |
| 1,3-Divinylsulfonyl-2-propanol | 120 $mg/m^2$ |

Composition (13)

| Protective Layer (3) | |
|---|---|
| Gelatin | 0.8 $mg/m^2$ |

-continued

| Protective Layer (3) | |
|---|---|
| Fine Polymethyl Methacrylate Grains (mean grain size: 3.4 μm) | 30 mg/m$^2$ |
| Sodium Dihexyl-α-sulfosuccinate | 15 mg/m$^2$ |
| Sodium Dodecylbenzenesulfonate | 15 mg/m$^2$ |
| Sodium Acetate | 40 mg/m$^2$ |

EXAMPLE I-5

A backing layer comprising Composition (17) and Protective Layer (3) comprising Composition (18), respectively, were coated on a support having the same electroconductive layer as that in Sample Nos. I-5 or I-10, on the side of the said electroconductive layer. Further, on the opposite surface of the thus-coated support, a silver halide emulsion layer comprising the following Composition (14) was coated in an amount of 3.8 g/m$^2$ as silver, and Protective Layers (1) and (2) each comprising Composition (15) and Composition (16), respectively, were further coated thereover. The samples thus-prepared were tested in the same manner as in Example I-1 with respect to the degree of pinholes formed. As a result, it was found that the samples of the present invention had noticeably reduced pinholes as compared with the comparative sample having no electroconductive layer.

Composition (14)

An aqueous silver nitrate solution and an aqueous sodium chloride solution containing ammonium hexachlororhodate(III) in an amount of $1.3\times10^{-4}$ mol per mol of silver were simultaneously added to an aqueous gelatin solution kept at 35° C. over a period of 10 minutes, whereupon the potential was controlled to be 200 mV. Accordingly, monodispersed cubic silver chloride grains having a mean grain size of 0.08 μm were obtained. After formation of the grains, the soluble salts were removed by a well known flocculation method, and 4-hydroxy-6-methyl-1,3,3a,7-tetraazaindene and 1-phenyl-5-mercaptotetrazole were added to the resulting emulsion as stabilizing agents.

To the thus-prepared emulsion were added Compound I-19) of the present invention ($1\times10^{-4}$ mol/mol of Ag) and Compound I-5) of the present invention ($1\times10^{-3}$ mol/mol of Ag) as contrast-increasing agents. Further, polyethyl acrylate latex was added thereto in an amount (solid content) of 50% by weight of gelatin. Additionally, 145 mg/m$^2$ of 2-bis(vinylsulfonylacetamido)ethane was added thereto as a hardening agent.

Composition (15)

| Protective Layer (1) | |
|---|---|
| Gelatin | 1 g/m$^2$ |
| Thioctic Acid | 6 mg/m$^2$ |
| Compound-10 | 90 mg/m$^2$ |
| 1,5-Dihydroxy-2-benzaldoxime | 35 mg/m$^2$ |
| Sodium Dodecylbenzenesulfonate | 10 mg/m$^2$ |
| Sodium Polystyrenesulfonate | 20 mg/m$^2$ |
| Ethyl Acrylate Latex (mean grain size: 0.05 μm) | 0.2 g/m$^2$ |

Composition (16)

| Protective Layer (2) | |
|---|---|
| Gelatin | 0.6 g/m$^2$ |
| Compound-11 | 0.1 g/m$^2$ |
| Fine Polymethyl Methacrylate Grains (mean grain size: 2.5 μm) | 20 mg/m$^2$ |
| Fine Silicone Dioxide Grains (mean grain size: 2.9 μm) | 30 mg/m$^2$ |
| Potassium N-Perfluorooctanesulfonyl-N-propylglycine) | 3 mg/m$^2$ |
| Sodium Dodecylbenzenesulfonate | 20 mg/m$^2$ |

Compound-11 was added in the form of a gelatin dispersion in accordance with the procedure mentioned below.

18.9 g of Compound-11 was dissolved in 25 ml of N,N-dimethylsulfonamide, and the resulting solution was dispersed into 536 g of an aqueous 6.5 wt % gelatin solution containing 13 g of Compound-12 with stirring to obtain a dispersion. This was incorporated into Composition (16).

Composition (17)

| Backing Layer | |
|---|---|
| Gelatin | 2.5 g/m$^2$ |
| Compound-5 | 0.26 g/m$^2$ |
| Compound-6 | 30 mg/m$^2$ |
| Compound-7 | 40 mg/m$^2$ |
| Compound-8 | 90 mg/m$^2$ |
| Sodium Dihexyl-α-sulfosuccinate | 30 mg/m$^2$ |
| Sodium Dodecylbenzenesulfonate | 35 mg/m$^2$ |
| 1,3-Divinylsulfonyl-2-propanol | 130 mg/m$^2$ |
| Ethyl Acrylate Latex (mean grain size: 0.05 μm) | 0.5 g/m$^2$ |

Composition (18)

| Protective Layer (3) | |
|---|---|
| Gelatin | 0.8 g/m$^2$ |
| Fine Polymethyl Methacrylate Grains (mean grain size: 3.4 μm) | 40 mg/m$^2$ |
| Sodium Dihexyl-α-sulfosuccinate | 9 mg/m$^2$ |
| Sodium Dodecylbenzenesulfonate | 10 mg/m$^2$ |
| Sodium Acetate | 40 mg/m$^2$ |

Compound-9, -10, -11 and -12 were as follows.

Compound-9

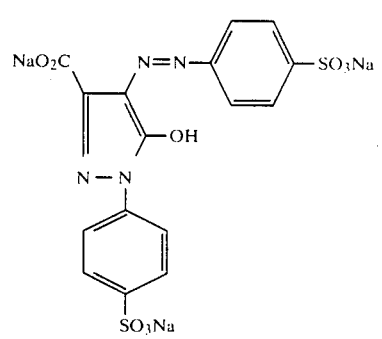

-continued

Compound-10

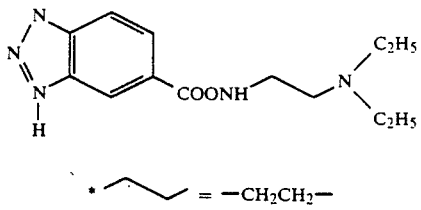

Compound-11

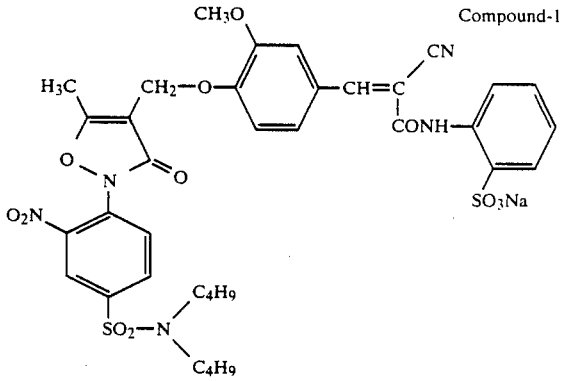

Compound-12

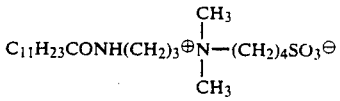

EXAMPLE II-1

A subbing layer, an electroconductive layer, an emulsion layer, a protective layer and a backing layer were coated on a 100 μm thick polyethylene terephthalate support, as indicated in Table II-1 below, to prepare Samples (A) to (H).

The layer constitution of the samples is shown in the FIGURE attached hereto, where 1 is a polyethylene terephthalate film support, 1-1 is a first subbing layer, 1-2 is a second subbing layer, 2 is an electroconductive layer, 3 is an emulsion layer, 4 is a protective layer, 5 is a backing layer.

TABLE II-1

| | Obverse | | | | | Reverse | | | |
|---|---|---|---|---|---|---|---|---|---|
| Sample | 1st Subbing Layer | Electro-conductive Layer | 2nd Subbing Layer | Emulsion Layer | Protective Layer | 1st Subbing Layer | Electro-conductive Layer | 2nd Subbing Layer | Backing Layer |
| (A) | (1) | No | No | (3) | (4)-1 | (1) | No | No | (5) |
| (B) | (1) | No | No | (3) | (4)-2 | (1) | No | No | (5) |
| (C) | (1) | (2) | (1) | (3) | (4)-1 | (1) | (2) | (1) | (5) |
| (D) | (1) | (2) | (1) | (3) | (4)-2 | (1) | (2) | (1) | (5) |
| (E) | (1) | No | No | (3) | (4)-1 | (1) | (2) | (1) | (5) |
| (F) | (1) | No | No | (3) | (4)-2 | (1) | (2) | (1) | (5) |
| (G) | (1) | (2) | (1) | (3) | (4)-1 | (1) | No | No | (5) |
| (H) | (1) | (2) | (1) | (3) | (4)-2 | (1) | No | No | (5) |

Note:
Samples (D), (F) and (H) are those of the present invention.

Coating compositions for the layers were prepared as follows:

Composition 1)

| First and Second Subbing Layers | |
|---|---|
| Gelatin | 30 mg/m² |
| Salicylic Acid | 15 mg/m² |
| Reaction Product of Polyamide (made of diethylenetriamine and adipic acid) and Epichlorohydrin | 30 mg/m² |

Composition 2)

| Metal Oxide-Containing Electroconductive Layer | |
|---|---|
| Gelatin | 35 mg/m² |
| $SnO_2$/Sb (8/2) (grain size: 0.3 μm) | 250 mg/m² |
| 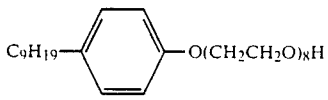 | 5 mg/m² |

Silver halide emulsion coating composition was prepared as mentioned below.

An aqueous silver nitrate solution and an aqueous sodium chloride solution containing ammonium hexachlororhodate(III) in an amount of $5\times10^{-6}$ mol per mol of silver were simultaneously added to an aqueous gelatin solution at 40° C. over a period of 20 minutes with stirring by a double jet method to obtain a monodispersed silver chloride emulsion having a mean grain size of 0.15 μm. After formation of the grains, the soluble salts were removed, and gelatin was added. Without being chemically sensitized, 4-hydroxy-6-methyl-1,3,3a,7-tetraazaindene ($5\times10^{-3}$ mol/mol of silver) and 1-phenyl-5-mercaptotetrazole ($5\times10^{-4}$ mol per mol of silver) were added to the emulsion as stabilizing agents.

To the resulting silver halide emulsion were added the additives mentioned below to prepare Coating Composition 3). This was coated on the polyethylene terephthalate support (thickness: 100 μm) having the above-mentioned subbing layers made of Composition 1) and electroconductive layer made of Composition 2).

The amount of the emulsion layer coated was 3.5 g/m² as silver.

Composition 3)

| Silver Halide Emulsion Layer | |
|---|---|
| Gelatin | 2.0 g/m² |
| Polymer Latex (polyethyl acrylate compound described in JP-B-45-5331, Production Example 3) | 0.8 g/m² |
| Sodium p-Dodecylbenzenesulfonate | 40 mg/m² |

-continued

| Silver Halide Emulsion Layer | |
|---|---|
| Dye Compound 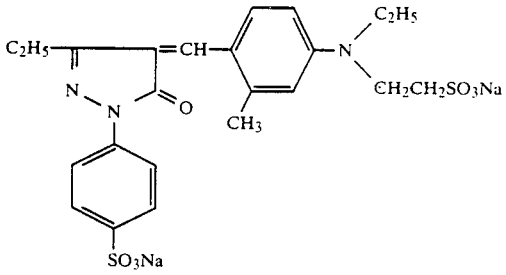 | 120 mg/m$^2$ |
| Hydrazine Derivative (Compound I-30)) | 35 mg/m$^2$ |
| 1,3-Divinylsulfonyl-2-propanol | 100 mg/m$^2$ |

Over the emulsion layer thus-coated, a protective layer comprising the following Composition (4)-1 or (4)-2 was coated:

| Composition of Protective Layer: | Composition (4)-1 | Composition (4)-2 |
|---|---|---|
| Gelatin | 1.2 g/m$^2$ | 1.2 g/m$^2$ |
| Matting Agent (polymethyl methacrylate having mean grain size of 3.0 μm) | 30 mg/m$^2$ | 30 mg/m$^2$ |
| Polymer Latex (polyethyl acrylate compound described in JP-B-45-5331, Production Example 3) | 0.3 g/m$^2$ | 0.3 g/m$^2$ |
| Sodium p-Dodecylbenzene-sulfonate | 25 mg/m$^2$ | 25 mg/m$^2$ |
| 1,3-Divinylsulfonyl-2-propanol | 40 mg/m$^2$ | 40 mg/m$^2$ |
| Compound F-5) | — | 5 mg/m$^2$ |

The backing layer coated had the following composition:

Composition 5)

| Backing Layer | |
|---|---|
| Gelatin | 3 g/m$^2$ |
| Matting Agent (polymethyl methacrylate having mean grain size of 3.5 μm) | 30 mg/m$^2$ |
| Polymer Latex (polyethyl acrylate compound described in JP-B-45-5331, Production Example 3) | 0.5 g/m$^2$ |
| Sodium p-Dodecylbenzenesulfonate | 40 mg/m$^2$ |
| 1,3-Divinylsulfonyl-2-propanol | 150 mg/m$^2$ |
| Dye Compound 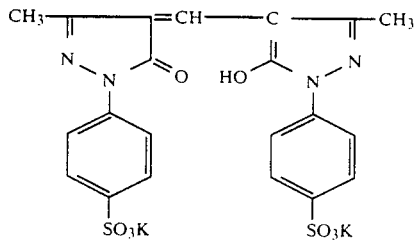 | 200 mg/m$^2$ |
| Dye Compound 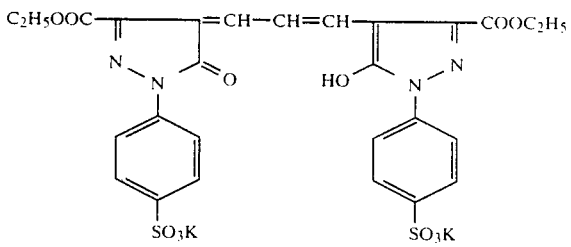 | 50 mg/m$^2$ |

-continued

| Backing Layer | | |
|---|---|---|
| Dye Compound | 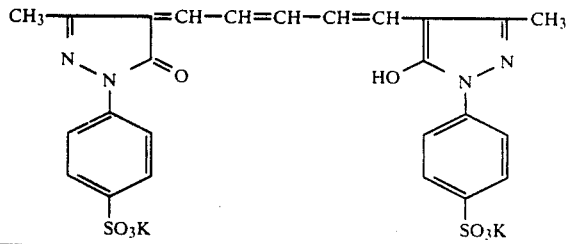 | 50 mg/m² |

Each of the thus-prepared Samples (A) to (H) was exposed through a dot image original by contact exposure with FPA-800 Type Printer (manufactured by Fuji Photo Film Co., Ltd.) and then developed with an automatic developing machine FG-660F (manufactured by Fuji Photo Film Co., Ltd.). The development time was 20 seconds and the development temperature was 38° C.

The optimum exposure amount for each sample was so selected that 50% dot of the original gave 50% dot image in the film after contact exposure and development.

In the thus-processed samples, the degree of pinholes appeared in the 100% blackened region was checked and compared with one another.

The sensitivity of each sample was represented by the reciprocal of the exposure amount to give the same dot image as in Sample (A), on the basis of the sensitivity of Sample (B) of being 100.

For evaluation of the degree of pinholes formed in the processed samples, the samples were graded by ten grades (1) to (10). That is, (10) means that the sample had no pinhole, and (1) means that the sample had most pinholes.

The results obtained are shown in Table II-2 below.

As is obvious from the results therein, Samples (C), (D), (E), (F), (G) and (H) of the present invention had noticeably reduced pinholes without worsening other photographic property (e.g., sensitivity). Particularly, Samples (D), (F) and (H) in which the fluorine-containing surfactant, Compound F-5, was used in the protective layer and the electroconductive layer was provided had extremely reduced pinholes.

TABLE II-2

| Sample No. | Relative Sensitivity | Pinhole Level |
|---|---|---|
| (A) (Comparison) | 100 | 1 |
| (B) (Comparison) | 98 | 3 |
| (C) (Invention) | 98 | 7 |
| (D) (Invention) | 98 | 10 |
| (E) (Invention) | 100 | 6 |
| (F) (Invention) | 100 | 10 |
| (G) (Invention) | 98 | 4 |
| (H) (Invention) | 97 | 8 |

While the invention has been described in detail and with reference to specific embodiments thereof, it will be apparent to one skilled in the art that various changes and modifications can be made therein without departing from the spirit and scope thereof.

What is claimed is:

1. A silver halide photographic material which comprises a support having thereon at least one silver halide emulsion layer and at least one hydrophilic colloid layer wherein at least one of said silver halide emulsion layers and the hydrophilic colloid layers contains a hydrazine derivative represented by formula (I), and also having thereon, as a constitutional layer, at least one electroconductive layer having a surface resistivity of $1\times10^{12}\Omega$ or less in an atmosphere of 25° C. and 25% RH;

$$R_1-\underset{\underset{A_1}{|}}{N}-\underset{\underset{A_2}{|}}{N}-G_1-R_2 \qquad (I)$$

wherein $R_1$ represents an aliphatic or an aromatic group; $R_2$ represents a hydrogen atom, an alkyl group, an aryl group, an alkoxy group, an aryloxy group, an amino group, a carbamoyl group or an oxycarbonyl group; $G_1$ represents a carbonyl group, a sulfonyl group, a sulfoxy group, $$-\overset{\overset{O}{\|}}{\underset{\underset{R_2}{|}}{P}}-$$

or an iminomethylene group; $A_1$ and $A_2$ are both hydrogen atoms, or one of them represents a hydrogen atom and the other represents a substituted or substituted alkylsulfonyl group, a substituted or unsubstituted arylsulfonyl group, or a substituted or unsubstituted acyl group;

wherein the electroconductive layer contains an electroconductive metal oxide selected from the group consisting of ZnO, $TiO_2$, $SnO_2$, $Al_2O_3$, $In_2O_3$, $SiO_2$, MgO, BaO, $MoO_3$, $V_2O_5$ or complex oxides thereof; and wherein at least one layer of the material contains a fluorine-containing surfactant.

2. The silver halide photographic material as in claim 1, wherein the electroconductive metal oxide is selected from the group consisting of ZnO, $TiO_2$ and $SnO_2$.

3. The silver halide photographic material as in claim 1, wherein the electroconductive metal oxide is selected from the group consisting of ZnO which contains from 0.01 mol % to 30 mol % of diverse atom(s) comprising at least one of Al and In; $SnO_2$ which contains from 0.01 mol % to 30 mol % of diverse atom(s) comprising at least one of Sb, Nb, and halogen atom(s); and $TiO_2$ which contains from 0.01 mol % to 30 mol % of diverse atom(s) comprising at least one of Nb and Ta.

4. The silver halide photographic material as in claim 1, wherein the fine electroconductive metal oxide is in the form of grains having a volume resistivity of $1\times10^7$ ω·cm or less.

5. The silver halide photographic material as in claim 1, wherein the fluorine-containing surfactant is selected from anionic, cationic, betaine type or nonionic surfactants containing a fluoroalkyl group, an alkenyl group or an aryl group, having 4 or more carbon atoms.

6. The silver halide photographic material as in claim 1, wherein the at least one silver halide emulsion layer is composed of a silver chloride emulsion or a silver chlorobromide emulsion having a silver chloride content of 80 mol % or more, at least one of the silver halide emulsion layer and other hydrophilic colloidal layers contains a fluoride-containing surfactant, and the electroconductive layer contains an electroconductive metal oxide.

* * * * *